US008470105B2

(12) United States Patent
Kochi et al.

(10) Patent No.: US 8,470,105 B2
(45) Date of Patent: Jun. 25, 2013

(54) PROCESS FOR MANUFACTURING A HIGH CARBON STEEL WIRE MATERIAL HAVING EXCELLENT WIRE DRAWABILITY

(75) Inventors: Takuya Kochi, Kobe (JP); Shogo Murakami, Kobe (JP); Hiroshi Yaguchi, Kobe (JP); Takeshi Kuroda, Kakogawa (JP); Hidenori Sakai, Kakogawa (JP); Tomotada Maruo, Kobe (JP); Takaaki Minamida, Kakogawa (JP)

(73) Assignee: Kobe Steele, Ltd., Kobe-shi (JP)

( * ) Notice: Subject to any disclaimer, the term of this patent is extended or adjusted under 35 U.S.C. 154(b) by 178 days.

(21) Appl. No.: 12/466,865

(22) Filed: May 15, 2009

(65) Prior Publication Data

US 2009/0223610 A1 Sep. 10, 2009

Related U.S. Application Data

(62) Division of application No. 11/296,299, filed on Dec. 8, 2005, now abandoned.

(30) Foreign Application Priority Data

Dec. 22, 2004 (JP) ..... 2004-371901

(51) Int. Cl.
*C21D 8/06* (2006.01)

(52) U.S. Cl.
USPC ..... 148/595; 148/598; 148/580; 148/602

(58) Field of Classification Search
USPC ..... 148/595, 598, 602, 580, 654, 320
See application file for complete search history.

(56) References Cited

U.S. PATENT DOCUMENTS 5,125,987 A * 6/1992 Eguchi et al. ..... 148/595
5,167,727 A 12/1992 Kim et al.

(Continued)

FOREIGN PATENT DOCUMENTS

EP 0 620 284 A2 10/1994
EP 1 277 846 A1 1/2003

(Continued)

OTHER PUBLICATIONS

Machine-English translation of Japanese patent 05-117765, Murakami Toshiyuki et al., May 14, 1993.*

(Continued)

*Primary Examiner* — Deborah Yee
(74) *Attorney, Agent, or Firm* — Oblon, Spivak, McClelland, Maier & Neustadt, L.L.P.

(57) ABSTRACT

A high carbon steel wire material which is made of high carbon steel as a raw material for wire products such as steel cords, bead wires, PC steel wires and spring steel, allows for these wire products to be manufactured efficiently at a high wire drawing rate and has excellent wire drawability and a manufacturing process thereof.

This high carbon steel wire material is made of a steel material having specific contents of C, Si, Mn, P, S, N, Al and O, and the Bcc-Fe crystal grains of its metal structure have an average crystal grain diameter ($D_{ave}$) of 20 μm or less and a maximum crystal grain diameter ($D_{max}$) of 120 μm or less, preferably an area ratio of crystal grains having a diameter of 80 μm or more of 40% or less, an average sub grain diameter ($d_{ave}$) of 10 μm or less, a maximum sub grain diameter ($d_{max}$) of 50 μm or less and a ($D_{ave}/d_{ave}$) ratio of the average crystal grain diameter ($D_{ave}$) to the average sub grain diameter ($d_{ave}$) of 4.5 or less.

14 Claims, 6 Drawing Sheets

U.S. PATENT DOCUMENTS

| | | | |
|---|---|---|---|
| 5,458,699 | A | 10/1995 | Tsukamoto et al. |
| 5,575,866 | A | 11/1996 | Minamida et al. |
| 5,873,961 | A | 2/1999 | Bhagwat et al. |
| 6,783,609 | B2 | 8/2004 | Hata et al. |
| 6,800,147 | B2 | 10/2004 | Nagao et al. |
| 7,037,387 | B2 | 5/2006 | Nagao et al. |
| 2004/0129354 | A1 | 7/2004 | Nagao et al. |
| 2005/0087270 | A1 | 4/2005 | Nagao et al. |
| 2005/0155672 | A1 | 7/2005 | Nagao |
| 2006/0196584 | A1 | 9/2006 | Kochi et al. |
| 2007/0125456 | A1 | 6/2007 | Kochi et al. |
| 2007/0277913 | A1 | 12/2007 | Kochi et al. |
| 2009/0007998 | A1 | 1/2009 | Kochi et al. |
| 2009/0065105 | A1 | 3/2009 | Kochi et al. |

FOREIGN PATENT DOCUMENTS

| | | | |
|---|---|---|---|
| EP | 1 473 375 | A1 | 11/2004 |
| EP | 1 577 410 | A1 | 9/2005 |
| JP | 62-130258 | | 6/1987 |
| JP | 8-295930 | | 11/1996 |
| JP | 10-158785 | | 6/1998 |
| JP | 2003-82434 | | 3/2003 |
| JP | 2003-226937 | | 8/2003 |
| JP | 2004-91912 | | 3/2004 |
| JP | 2004-137597 | | 5/2004 |
| JP | 2004-149816 | | 5/2004 |
| JP | 2005-206853 | | 8/2005 |

OTHER PUBLICATIONS

Machine-English translation of Japanese patent 11-302784, Hajime Ishikawa et al., Nov. 2, 1999.*

Computer-generated English translation of Japanese patent 2000-119808, Apr. 25, 2000, Kako Hiroshi et al.

Computer-generated English translation of Japanese patent 2000-073137, Nagao, Mamoru et al., Mar. 7, 2000.

U.S. Appl. No. 12/160,913, filed Jul. 15, 2008, Kochi, et al.

U.S. Appl. No. 12/063,324, filed Feb. 8, 2008, Kuroda, et al.

* cited by examiner

PROCESS FOR MANUFACTURING A HIGH CARBON STEEL WIRE MATERIAL HAVING EXCELLENT WIRE DRAWABILITY

The present application is a Divisional of application Ser. No. 11/296,299 filed Dec. 8, 2005, which is now abandoned.

BACKGROUND OF THE INVENTION

1. Field of the Invention

The present invention relates to a carbon steel wire material which is made of high carbon steel as a raw material for wire products such as steel cords, bead wires, PC steel wires and spring steel, allows for these wire products to be manufactured efficiently at a high wire drawing rate and has excellent wire drawability.

2. Description of Related Art

To manufacture the above wire products, wire drawing is carried out on a steel wire material as a raw material for the control of size and material (mechanical properties) in most cases. Therefore, the improvement of the wire drawability of a steel wire material is extremely useful for the enhancement of productivity and the like. When wire drawability is improved, many advantages such as the improvement of productivity by an increase in wire drawing rate and a reduction in the number of passes for wire drawing and also the extension of the service life of a die can be enjoyed.

As for wire drawing, researches have been mainly focused on wire breakage resistance at the time of wire drawing. For example, patent document 1 discloses technology for improving wire breakage resistance by optimizing the size of a pearlite block, the amount of proeutectoid cementite, the thickness of cementite and the Cr content of cementite, paying attention to these.

Patent document 2 reveals that the wire drawing limit is improved by controlling the area ratio of upper bainite and the size of bainite contained. Further, patent document 3 discloses technology for improving where breakage resistance and the service life of a die by controlling the total amount of oxygen contained in steel and the composition of a non-viscous inclusion. As for the service life of a die, the descalability of the surface of a steel wire material is also important. If scale remains on the surface of a steel wire material due to poor descalability, it causes the chipping of the die at the time of wire drawing. Therefore, patent document 4 discloses technology for improving mechanical descalability by controlling pores existent in scale.

However, the above prior arts place main emphasis on the improvement of wire breakage resistance under specific wire drawing conditions and rarely pay attention to the improvement of wire drawing rate, the reduction of the number of passes for wire drawing and the extension of the service life of a die from the viewpoint of wire drawability. As previously disclosed, increases in wire drawing rate and the area reduction rate per pass lead to the deterioration of the ductility of wire products and the shortage of the service life of the die. However, the effect of improving wire drawability to such an extent that increases in wire drawing rate and area reduction rate can be achieved at practical levels is not obtained yet from the above prior arts.

Patent document 1 JP-A2004-91912 (the term "JP-A" as used herein means an "unexamined published Japanese patent application")

Patent document 2 JP-A 8-295930

Patent document 3 JP-A 62-130258

Patent document 4 Japanese Patent No. 3544804

SUMMARY OF THE INVENTION

It is an object of the present invention which has been made in the view of the above situation to provide a steel wire material having excellent wire drawability which makes it possible to increase the wire drawing rate and the area reduction rate and extend the service life of a die, attaching great importance to productivity, and a process capable of manufacturing the steel wire material efficiently.

As for the constitution of the high carbon steel wire material having excellent wire drawability of the present invention which can attain the above object, the high carbon steel wire material contains 0.6 to 1.1% by mass of C, 0.1 to 2.0% by mass of Si, 0.1 to 1.0% by mass of Mn, 0.020% or less by mass of P, 0.020% or less by mass of S, 0.006% or less by mass of N, 0.03% or less by mass of Al and 0.0030% or less by mass of O, the balance consisting of Fe and unavoidable impurities, the Bcc-Fe crystal grains of its metal structure having an average crystal grain diameter ($D_{ave}$) of 20 μm or less and a maximum crystal grain diameter ($D_{max}$) of 120 μm or less.

As a preferred mode of the above steel material according to the present invention, the bcc-Fe crystal grains of the above metal structure have an area ratio of crystal grains having a diameter of 80 μm or more of 40% or less, an average sub grain diameter ($d_{ave}$) of 10 μm or less, a maximum sub grain diameter ($d_{max}$) of 50 μm or less, and a ($D_{ave}/d_{ave}$) ratio of the average crystal grain diameter ($D_{ave}$) to the average sub grain diameter ($d_{ave}$) of 4.5 or less, and further when the tensile strength of the steel wire material is represented by TS and the content of C in the steel wire material is represented by Wc, they satisfy the relationship of the following expression (1):

$$TS \leqq 1240 \times Wc^{0.52} \quad (1)$$

The steel wire material of the present invention may contain at least one element selected from 1.5% or less (not including 0%) by mass of Cr, 1.0% or less (not including 0%) by mass of Cu and 1.0% or less (not including 0%) by mass of Ni or at least one element selected from 5 ppm or less (not including 0 ppm) of Mg, 5 ppm or less (not including 0 ppm) of Ca and 1.5 ppm or less (not including 0 ppm) of REM.

Preferably, in the steel wire material of the present invention, the total decarbonization of the surface layer ($D_{m-T}$) is 100 μm or less and the adhesion of scale is 0.15 to 0.85% by mass.

Further, the process of the present invention is useful for the manufacture of a high carbon steel wire material having excellent wire drawability and the above characteristic properties.

A first manufacturing process comprises the steps of cooling a steel wire material made of steel which satisfies the above requirements for composition and heated at 730 to 1,050° C. to 470 to 640° C. ($T_1$) at an average cooling rate of 15° C./sec or more and heating it to 550 to 720° C. ($T_2$) which is higher than the above temperature ($T_1$) at an average temperature elevation rate of 3° C./sec or more.

A second manufacturing process comprises the steps of heating a steel material which satisfies the above requirements for composition at 900 to 1260° C., hot rolling it at a temperature of 740° C. or higher, finish rolling at a temperature of 1,100° C. or lower, cooling it with water to 750 to 950° C., winding it on a conveyor device, cooling it at an average cooling rate of 15° C./sec or more to 500 to 630° C. ($T_3$) within 20 seconds after winding, and heating it to 580 to 720° C. ($T_4$) within 45 seconds after winding. Herein, ($T_4$) is higher than the above value ($T_3$).

According to the present invention, a high carbon steel wire material which has excellent wire drawability and can enhance productivity due to increases in wire drawing rate and area reduction rate and can extend the service life of a die and a process capable of manufacturing the high carbon steel wire material having excellent wire drawability surely and efficiently can be provided by specifying the contents of C, Si, Mn, P, S, N, Al and O in the steel, specifying the average crystal grain diameter and the maximum crystal grain diameter of the bcc-Fe crystal grains of its metal structure, preferably suppressing the area ratio of coarse crystal grains and further specifying the average sub grain diameter and maximum sub grain diameter of the above bcc-Fe crystal grains and the ratio of these.

DETAILED DESCRIPTION OF THE PREFERRED EMBODIMENTS

Figure 1:
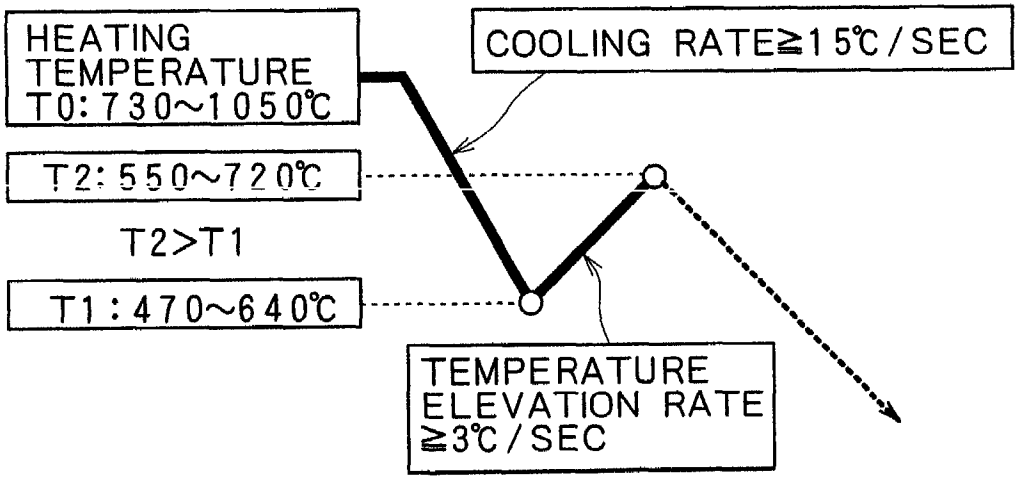
FIG. 1 is a schematic diagram of a production pattern employed in Experimental Example 1.

The reason why the chemical components of the steel material are specified in the present invention will be clarified and then the reason why the crystal grain diameter of the structure of the steel material will be explained in detail hereinunder.

The reason why the chemical components of the steel material are specified will be first explained.

C: 0.6% to 1.1% by mass

This is an element which has an influence upon the strength of an iron steel material. 0.6% or more by mass of C must be added to ensure strength required for steel cords, bead wires and PC steel wires to which the present invention is directed to. When the content of C is increased, strength becomes high but when it is too high, ductility deteriorates. Therefore, the upper limit of the content is set to 1.1% by mass.

Si: 0.1 to 2.0% by mass

This element is added specially for the deoxidation of a steel material which is drawn into a wire at a high ratio. 0.1% or more by mass of Si must be added. Since Si contributes to the strengthening of a steel material, its amount is increased as required. However, when it is added too much, upgrade solution solubility is increased and decarbonization is promoted, to which attention should be paid. In the present invention, the upper limit of this content is set to 2.0% by mass from the viewpoint of reducing strength and preventing decarbonization. The content of Si is more preferably 0.15 to 1.8% by mass.

Mn: 0.1 to 1.0% by mass 0.1% or more by mass of Mn must be added for deoxidation and to stabilize and make the harmful element S harmless as MnS. Mn also has the function of stabilizing a carbide contained in steel. However, when the content of Mn is too high, wire drawability is deteriorated by segregation and the formation of a supercooling structure. Therefore, the content of Mn must be reduced to 1.0% or less by mass. The content of Mn is more preferably 0.15 to 0.9% by mass.

P: 0.020% or more by mass

P is an element specially harmful for wire drawability. When it is too much, the ductility of a steel material deteriorates. Therefore, the upper limit of the content of P is set to 0.020% by mass in the present invention. The content of P is more preferably 0.015% or less by mass, much more preferably 0.010% or less by mass.

S: 0.020% or less

Although it is a harmful element, it can be stabilized as MnS by adding Mn as described above. However, when the content of S is to high, the amount and size of MnS become large and ductility deteriorates. Therefore, the upper limit of the content of S is set to 0.020% by mass in the present invention. The content of S is more preferably 0.015% or less by mass, much more preferably 0.010% or less by mass.

N: 0.006% or less by mass

It contributes to a rise in strength by age hardening but deteriorates ductility. Therefore, the upper limit of its content is set to 0.006% by mass in the present invention. The content of N is more preferably 0.004% or less by mass, much more preferably 0.003% or less by mass.

Al: 0.03% or less by mass

Al is effective as a deoxidizer and contributes to the formation of a fine metal structure when it is bonded to N to form AlN. However, when the content of Al is too high, a coarse oxide is formed to deteriorate wire drawability. Therefore, the upper limit of its content is set to 0.03% in the present invention. The content of Al is more preferably 0.01% or less by mass, much more preferably 0.005% or less by mass.

O: 0.003% or less by mass

When the amount of O contained in steel is large, a coarse oxide is readily formed and wire drawability deteriorates. Therefore, the upper limit of its content is set to 0.003% by mass in the present invention. The content of O is more preferably 0.002% or less by mass, much more preferably 0.0015% or less by mass.

The steel wire material of the present invention comprises the above chemical components as basic components, and the balance consists of iron and unavoidable impurities. It may contain the following elements as required.

Cr: 1.5% or less by mass

This is an element effective in increasing the strength of a steel material. When it is added too much, a supercooling structure is readily formed to deteriorate wire drawability. Therefore, the amount of Cr must be reduced to 1.5% or less by mass.

Cu: 1.0% or less by mass

Since it has the function of suppressing the decarbonization of the surface layer and also the function of increasing corrosion resistance, it can be added as required. However, when it is added too much, it readily causes cracking during hot working and also exerts a bad influence upon wire drawability due to the formation of a supercooling structure. Therefore, the upper limit of its content is set to 1.0% by mass in the present invention.

Ni: 1.0% or less by mass

Since it is effective in suppressing the decarbonization of the surface layer and improving corrosion resistance like Cu, it is added as required. However, when it is added too much, wire drawability is deteriorated by the formation of a supercooling structure. Therefore, its content must be reduced to 1.0% or less by mass.

Mg: 5 ppm or less

Since Mg has the function of softening an oxide, it can be added as required. However, when it is added too much, the properties of an oxide change to deteriorate wire drawability. Therefore, its content is 5 ppm at maximum, preferably 2 ppm or less.

Ca: 5 ppm or less

Ca has the function of softening an oxide as well and may be added as required. However, when it is added too much, the properties of an oxide change to deteriorate wire drawability. Therefore, its content must be reduced to 5 ppm or less, preferably 2 ppm or less.

REM: 1.5 ppm or less

REM has the function of softening an oxide as well and may be added as required. However, when it is added too much, the properties of an oxide change to deteriorate wire drawability like Mg and Ca. Therefore, the upper limit of its content is set to 1.5 ppm. The content of REM is more preferably 0.5 ppm or less.

A description is subsequently given of the metal structure.

In the present invention, on condition that the above composition is satisfied, the essential feature of its metal structure is that "bcc-Fe crystal grains have an average crystal grain diameter ($D_{ave}$) of 20 μm or less and a maximum crystal grain diameter ($D_{max}$) of 120 μm or less".

More preferably, the above bcc-Fe crystal grains have "an area ratio of crystal grains having a diameter of 80 μm or more of 40% or less of the total area", "an average sub grain diameter ($d_{ave}$) of 10 μm or less and a maximum sub grain diameter ($d_{max}$) of 50 μm or less" or further "a ($D_{ave}/d_{ave}$) ratio of the average crystal grain diameter ($D_{ave}$) to the average sub grain diameter ($d_{ave}$) of 4.5 or less".

Typical wire breaking during wire drawing is, for example, cupping breakage or longitudinal/shear cracking as shown in "Wire Drawing Limitation of Hard Steel Wires and Its Control Factors, Plasticity and Processing" (Takahashi et al.), vol. 19 (1978), pp. 726. According to this, the cupping breakage occurs when the pearlite block of a wire material is coarse and has poor ductility. For example, JP-A2004-91912 is also aimed to improve breakage resistance by controlling the grain no. of the pearlite block to Nos. 6 to 8. However, even in this invention, a rise in wire drawing rate at the time of drawing a wire is not realized yet.

Then the inventors of the present invention tried to control the sizes and distribution of crystal grain diameters based on the concept that "cupping breakage occurs because voids are formed and grow in a portion where crystal rotation does not take place smoothly during wire drawing and when coarse crystal grains are existent, voids are formed in that portion and cause breakage even though the average crystal grain diameter represented by crystal grain number is reduced."

Since a relatively high carbon steel wire material to which the present invention is directed to is often controlled by the structure of pearlite mainly, the ductility of the wire material is often represented by a pearlite block ("factors of controlling the ductility of eutectoid pearlite steel", Takahashi et al., bulletin of the Nippon Metal Society of Japan, vol. 42 (1978), pp. 708). However, as an ordinary steel material contains other structures such as ferrite and bainite, the inventors of the present invention have conducted studies based on the idea that the sizes and distribution of all crystal grain diameters including structures other than pearlite should be taken into consideration.

As a result, it has been found that when the average crystal grain diameter ($D_{ave}$) is reduced to 20 μm or less and the maximum crystal grain diameter ($D_{max}$) is controlled to 120 μm or less as specified by the present invention, wire drawability is greatly improved. When the average crystal grain diameter ($D_{ave}$) is larger than 20 μm, the ductility of a wire becomes unsatisfactory. Even when the average crystal grain diameter ($D_{ave}$) is 20 μm or less, if the maximum crystal grain diameter ($D_{max}$) is larger than 120 μm, the wire is easily broken during wire drawing. Further, to obtain higher wire drawability, the average crystal grain diameter ($D_{ave}$) is preferably set to 17 μm or less and the maximum crystal grain diameter ($D_{max}$) is preferably set to 100 μm or less.

Although the object of the present invention is attained by specifying the above average crystal grain diameter ($D_{ave}$) and the above maximum crystal grain diameter ($D_{max}$) of the metal structure, in order to further improve wire drawability, the following requirements are desirably satisfied in addition to these requirements.

That is, when the area ratio of crystal grains having a diameter of 80 μm or more is controlled to 40% or less in the bcc-Fe crystal grains of the metal structure to make all the crystal grains uniform and fine, wire drawability can be further improved. The area ratio of crystal grains having a grain diameter of 80 μm or more is preferably 25% or less, particularly preferably 0%.

When studies have been conducted to further improve wire drawability, it has been found that so-called "sub grains" which are crystal units having a low angle boundary with adjacent crystals also have an influence upon crystal rotation and that wire drawability can be further improved by suppressing the average sub grain diameter ($d_{ave}$) to 10 μm or less and the maximum sub grain diameter ($d_{max}$) to 50 μm or less. That is, it is considered that when the number of coarse sub grains is made small and sub grains are made uniformly and fine, stress concentration is reduced and the formation of voids is suppressed. The average sub grain diameter ($d_{ave}$) and the maximum sub grain diameter ($d_{max}$) are preferably 7 μm or less and 40 μm or less, respectively, to obtain the above effect.

Further, as for the average crystal grain diameter ($D_{ave}$) and the average sub grain diameter ($d_{ave}$), it has been confirmed that when the ($D_{ave}/d_{ave}$) ratio of these is made small within the above ranges, wire drawability is further improved. This is considered to be because crystal rotation during wire drawing becomes smooth over the entire steel material, thereby making it difficult to cause the concentration of stress. The ($D_{ave}/d_{ave}$) ratio is preferably 4.5 or less, more preferably 4.0 or less to obtain this function effectively.

In order to further improve wire (drawability in the present invention, the control of the tensile strength of a steel wire material and the content of C in the steel wire material to satisfy the relationship "TS [Mpa]$\leqq 1240 \times Wc^{0.52}$" (TS is the tensile strength of the steel wire material and Wc is the content of C in the steel wire material) is also effective.

When the wire drawing rate and the area reduction rate are increased, voids are readily formed and the temperatures of the steel wire material and the die rise, thereby causing wire breakage (longitudinal/shear cracking) and reducing the service life of the die. When the wire drawing rate and the area reduction rate remain unchanged, a temperature rise has a great influence upon the strength of the wire material. As the tensile strength is lower, the temperature rise becomes lower. It has been confirmed that the tensile strength is almost determined by the content of C in the steel wire material, and that when the relationship between the tensile strength (TS) and the content of C in the steel wire material (Wc) is controlled to satisfy the above expression, breakage caused by a temperature rise at the time of wire drawing is significantly suppressed and the service life of the die is improved.

In addition, in the present invention, when the influences of the decarbonization of the surface layer of the steel wire material and the adhesion of scale upon wire drawability has been studied to further improve wire drawability, it has been confirmed that a steel wire material having a total decarbonization of the surface layer ($D_{m-T}$) of 100 μm or less and an adhesion of scale to the surface layer of 0.15 to 0.85% by mass shows excellent wire drawability as well.

Even when wire drawability is improved by the component design and structure control of a steel wire material, wire drawability is influenced by the properties of scale on the surface of the steel wire material. Although a steel wire material is descaled chemically and mechanically before it is drawn, when wire drawing is carried out while scale is not removed completely and remains in the step, the die is chipped. The adhesion of scale has a great influence upon descalability. As the adhesion of scale is larger, descalability becomes better. When the adhesion is too large, scale is removed before descaling process and the wire material may be rusted. When decarbonization occurs on the surface of the steel wire material, even if the adhesion of scale is satisfactory, scale bites into the decarbonated portion, making descaling difficult. Therefore, in the present invention, when the requirements for reducing wire drawability impeding factors derived from scale as much as possible have been investigated, it has been confirmed that a reduction in wire drawability caused by scale can be suppressed immediately by controlling the total decarbonization of the surface layer ($D_{m-T}$) to 100 μm and the adhesion of scale to the surface layer to 0.15 to 0.85% by mass.

A description is subsequently given of the process for manufacturing a high carbon steel wire material having the above characteristic properties.

The first process comprises the steps of cooling a steel wire material heated at 730 to 1,050° C. and made of steel which satisfies the above requirements for Composition to 470 to 640° C. ($T_1$) at an average cooling rate of 15° C./sec or more and heating it to 550 to 720° C. ($T_2$) which is higher than the above temperature ($T_1$) at an average temperature elevation rate of 3° C./sec or more.

The second process comprises the steps of heating a steel material which satisfies the above requirements for composition at 900 to 1,260° C., hot rolling it at a temperature of 740° C. or higher, finish rolling it at a temperature of 1,100° C. or lower, water cooling it to a temperature range of 750 to 950° C., winding it on a conveyor device, cooling it at an average cooling rate of 15° C./sec or more to 500 to 630° C. ($T_3$) within 20 seconds after winding, and then heating it to 580 to 720° C. ($T_4$) within 45 seconds after winding. Herein, ($T_4$) is higher than the above value ($T_3$).

That is, to obtain a steel wire material having the above characteristic properties, a carbide in a steel material must be heated at 730° C. or higher to be dissolved so as to make its structure before transformation uniform. Although descalability improves as the heating temperature becomes higher, when the heating temperature exceeds 1,050° C., austenite grains before transformation become coarse, making it difficult to control the structure by transformation in the subsequent cooling step. Therefore, the heating temperature must be reduced to 1,050° C. or lower. The preferred heating temperature is 750 to 1,000° C.

In the cooling step after heating, the bcc crystal grain diameter after transformation which is controlled in the present invention is determined. To reduce the crystal grain diameter as uniform and small as possible, it is recommended to increase the cooling rate after heating as much as possible. The average cooling rate is set to 15° C./sec or more in the present invention. As ($T_1$) at the time of cooling is lower, the crystal grains become finer. However, when the steel material is cooled to a temperature below 470° C., a supercooling structure which impairs wire drawability is readily formed. Therefore, the lower limit is set to 470° C. Since the average grain diameter becomes large when ($T_1$) is higher than 640° C., the steel material must be cooled to at least 640° C. The preferred ($T_1$) at the time of cooling is 480 to 630° C.

In the present invention, the wire material must be heated to 550 to 720° C. which is higher than ($T_1$) after the above cooling step for making the crystal grains fine. This temperature ($T_2$) at the time of temperature elevation has a marked influence upon the strength of the steel material. As the temperature ($T_2$) becomes higher, the strength lowers, which is advantageous for wire drawing. When the temperature is lower than 550° C., the reduction of strength becomes unsatisfactory and when the temperature is higher than 720° C. and becomes excessively high, transformation becomes uncompleted and may cause a rise in strength. ($T_2$) at the time of temperature elevation is preferably 580 to 715° C.

That is, after the steel material is cooled to 470 to 640° C. ($T_1$) (preferably 480 to 630° C.), it is re-heated at 550 to 720° C. ($T_2$) (preferably 580 to 715° C., more preferably 580 to 710° C.) which is higher than $T_1$ to obtain a steel material containing uniform and fine crystal grains and having low strength.

When the average temperature elevation rate from the temperature ($T_1$) to the temperature ($T_2$) is too low, the reduction of strength to the target level of the present invention is not effected. Therefore, the average temperature elevation rate between them must be 3° C./sec or more. That is, in order to obtain a steel wire material having excellent wire drawability with the above first process, it is important that a wire material heated at 730 to 1,050° C. (preferably 750 to 1,000° C.) should be cooled to 470 to 640° C. ($T_1$) (preferably 480 to 630° C.) at an average cooling rate of 15° C./sec or more and then heated to 550 to 720° C. ($T_2$) (preferably 580 to 715° C., more preferably 580 to 710° C.) at a rate of 3° C./sec or more. Herein, $T_2$ is higher than $T_1$.

Meanwhile, when a steel wire material to which the present invention is applied is a hot rolled wire material, the above second process is applied to control as follows.

First, the steel wire material is heated at 900 to 1,260° C. in a heating furnace, hot rolled at a temperature of 740° C. or higher and finish rolled at 1,100° C. or lower. When the heating temperature is lower than 900° C., heating is insufficient and when the temperature is higher than 1,260° C., the decarbonized area of the surface layer becomes wide. The heating temperature is preferably 900 to 1,250° C. When the rolling temperature is reduced, the decarbonization of the surface layer is promoted and descalability deteriorates. Therefore, the lower limit temperature of hot rolling is set to 740° C. The lower limit temperature is preferably 780° C. When the finish rolling temperature is higher than 1,100° C., the control of the transformation structure by cooling and re-heating in the subsequent step becomes difficult. Therefore, the upper limit of the finish rolling temperature is set to 1,100° C.

After finish rolling, the wire material is cooled to 750 to 950° C. with water and wound on a conveyor device such as a conveyor to be set. The control of temperature after water cooling is for the control of transformation and the control of scale in the subsequent step. When the temperature at the time of cooling becomes lower than 750° C., a supercooling structure is formed on the surface layer and when the temperature becomes higher than 950° C., the transformability of scale is lost and scale is peeled off at the time of transportation, causing the generation of rust by descaling during transportation.

After winding, it is important for obtaining a metal structure having excellent wire drawability that the steel material should be cooled at an average cooling rate of 15° C./sec or more, that the lowest value of the steel material temperature should be controlled to 500 to 630° C. ($T_3$) within 20 seconds from winding and setting on the conveyor device, and that the steel material should be heated again to 580 to 720° C. ($T_4$) higher than the above temperature ($T_3$) from the temperature ($T_3$) within 45 seconds after setting.

That is, by cooling the steel material at a rate of 15° C./sec or more so that the lowest temperature ($T_3$) becomes 500 to 630° C. within 20 seconds after winding and setting, the crystal grains can be made uniform and fine. When the cooling rate is lower than 15° C./sec, the cooling rate is insufficient and the metal structure cannot be made uniform and fine fully and some coarse grains are formed. Although the higher cooling rate is effective in making the metal structure fine, in the case of cooling with an air blast after hot rolling, variations in the cooling rate in the steel wire material tend to become large. Therefore, the average cooling rate after winding and setting is preferably set to 120° C./sec or less, more preferably to 100° C./sec or less. Even when the temperature becomes lower than 480° C. in this cooling step, a supercooling structure is formed on the surface layer and when the temperature becomes higher than 630° C., a coarse grain tends to be formed. Even when the wire material is not cooled to a preferred temperature range within 20 seconds from winding and setting, the metal structure becomes coarse.

After cooling, the strength of the hot rolled material can be significantly reduced by controlling the highest value of the steel material temperature to 580 to 720° C. ($T_4$) which is higher than the above temperature ($T_3$) from the temperature ($T_3$) within 45 seconds after winding and setting. To effectively promote the reduction of strength at this point, the time from winding and setting to the time when the above temperature range is reached is set to preferably 42 seconds or less, more preferably 40 seconds or less. When the temperature $T_4$ is lower than the temperature $T_3$ or when the temperature $T_4$ is lower than 580° C., the reduction of strength becomes unsatisfactory and when the temperature $T_4$ is higher than 720° C., both strength and ductility lower.

To obtain a hot rolled wire material having excellent wire drawability, the above second process is employed to heat a wire material at 900 to 1,260° C. (preferably 900 to 1,250° C.) in a heating furnace, hot roll it al a rolling temperature of 740° C. or higher (preferably 780° C. or higher), finish roll it at 1,100° C. or lower, cool it with water to 750 to 950° C. to be wound and set on the conveyor device, and cool it at a rate of 15° C./sec or more so as to control the lowest value of the steel material temperature to 500 to 630° C. ($T_3$) within 20 seconds from winding and setting and then the highest value of the steel material temperature to 580 to 720° C. ($T_4$), preferably to 580 to 715° C., more preferably to 580 to 710° C., which is higher than $T_3$ from the temperature $T_3$ within 45 seconds from winding and setting, thereby making it possible to obtain a high carbon steel wire material having excellent wire drawability efficiently.

EXAMPLES

The following experimental examples are provided to illustrate the constitution and function/effect of the present invention in more detail. It should be understood that the present invention is not limited by the following experimental examples and may be suitably modified in various ways without departing from the scope of the present invention and that all of them are included in the technical scope of the present invention.

Experimental Example 1

A hot rolled steel wire material having a diameter of 5.5 mm having chemical composition shown in Table 1 was manufactured. The amount of REM in Table 1 shows the total amount of La, Ce, Pr and Nd. The obtained hot rolled steel wire material was heated in an atmospheric furnace under conditions shown in FIG. 1 and Tables 2 and 3 and charged continuously into a lead furnace to be heated so as to obtain various steel wire materials. In this experimental example, the atmospheric furnace and the lead furnace were used to carry out the above heat treatment. The present invention is not limited to the use of these devices and other heating furnaces and holding furnaces may be used as a matter of course.

The structural features, scale characteristics and tensile characteristics of the obtained steel wire materials were evaluated. As for the crystal units of bcc crystal grains and sub grains out of the structural features, as the evaluation of variations in each crystal unit is important in the present invention, SEM/EBSP (Electron Back Scatter diffraction Pattern) was employed for the evaluation. The JSM-5410 of JEOL Ltd. was used as SEM and the OIM (Orientation Imaging Microscopy) System of TSL Co., Ltd. was used as EBSP.

After a sample was cut out from each steel wire material by wet cutting, wet polishing, buffing and chemical polishing were employed to prepare a sample for EBSP measurement, and a sample whose strain and surface unevenness caused by polishing were reduced as much as possible was thus prepared. The surface to be observed was polished as the longitudinal section of the steel wire material.

The obtained sample was measured with the center in the line diameter of the steel wire material as an EBSP measurement position. The measurement step was set to 0.5 μm or less, and the measurement area of each steel wire material was set to 60,000 $\mu m^2$ or more. Although the analysis of crystal orientation was carried out after measurement, the measurement result of the average CI (Confidence Index) value which was 0.3 or more was used for analysis to enhance analytical reliability.

Figure 2:
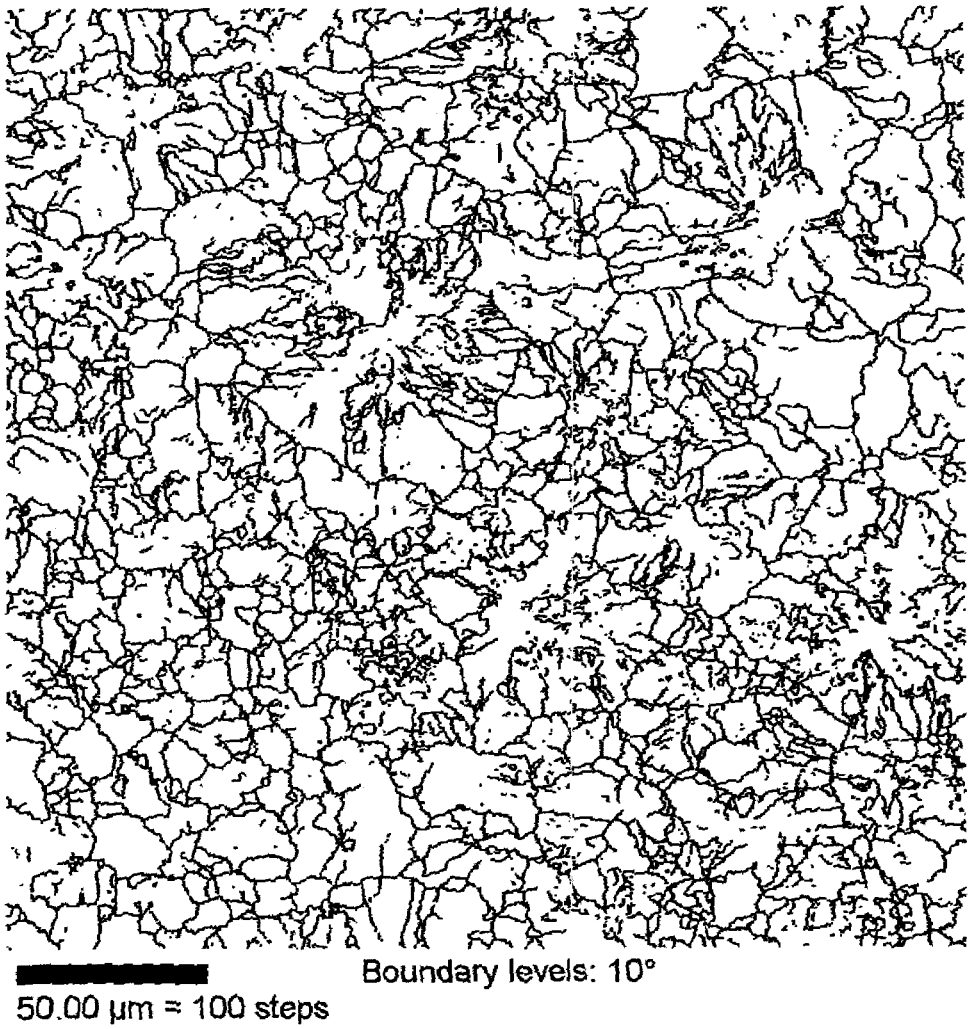
FIG. 2 is a diagram showing an example of the boundary map of the steel wire material obtained in the present invention.

The analytical results (boundary map: one example is shown in FIG. 2) of the "bcc crystal grain" which is an area surrounded by a boundary with an azimuth difference of 10° or more and "sub grain" which is an area surrounded by a boundary with an azimuth difference of 2° or more as crystal units intended by the present invention are obtained by the analysis of the bcc-Fe crystal orientation. The obtained boundary map was processed by the Image-Pro image analyzing software to calculate and evaluate each crystal unit.

Figure 3A:
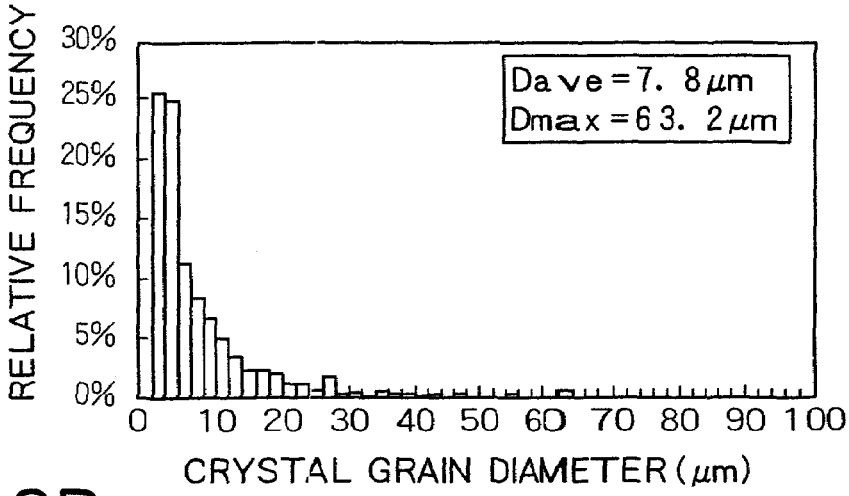
FIGS. 3(A), 3(B) and 3(C) are graphs showing the evaluation examples of the crystal units of the steel wire material obtained in Experimental Example 1.
Figure 3B:
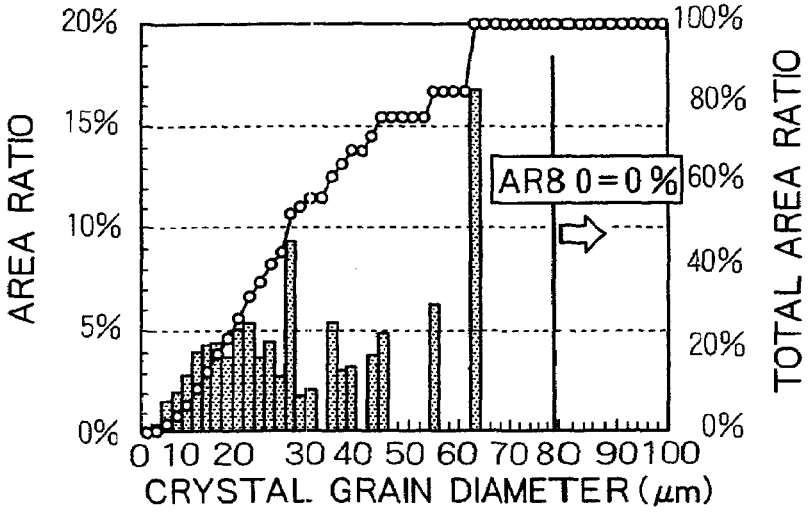
Figure 3C:
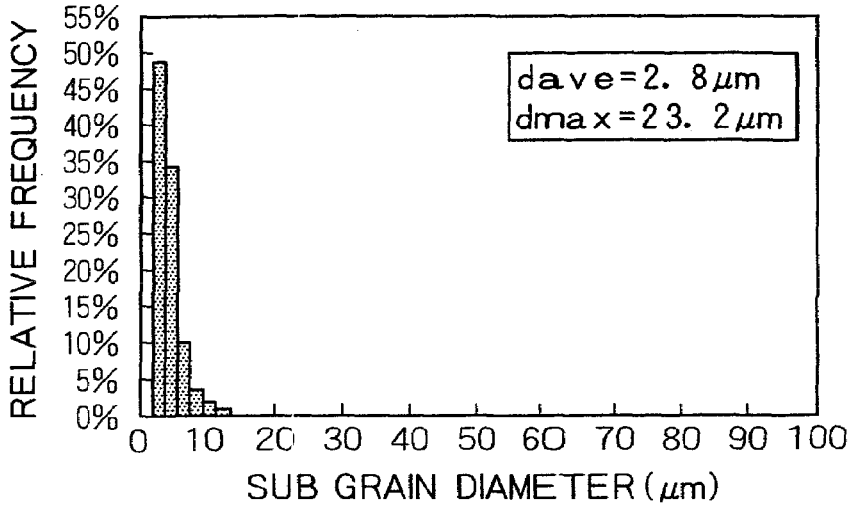

First, the area of each area (crystal unit) surrounded by a boundary is obtained based on the boundary map by the above Image-Pro. A circle diameter calculated by approximating each crystal unit to a circle equivalent diameter based on the area was used as the diameter of each crystal grain. The calculation results were statically processed as shown in examples of FIGS. 3(A) to 3(C) to obtain the average crystal grain diameter ($D_{ave}$), average sub grain diameter ($d_{ave}$), maximum crystal grain diameter ($D_{max}$), maximum sub grain diameter ($d_{max}$), area ratio of crystal grains having a grain diameter of 80 μm or more and ($D_{ave}/d_{ave}$) ratio of the average crystal grain diameter to the average sub grain diameter.

Out of the structure features, the total decarbonization is measured by the method described in Japanese Industrial Standards (JIS) G 0558. A sample was cut out from a steel wire material, buried in a resin so that the transverse section of the wire material became the surface to be observed, wet polished, baffed, and etched to expose the metal structure with 5% nital and observed through an optical microscope to measure the decarbonization of the surface layer of the steel wire material. The evaluation of decarbonization was made on two or more samples of each steel wire material to obtain a mean value.

The scale characteristics were evaluated based on the adhesion of scale to the surface layer of the steel wire material Stated more specifically, a 200 mm long sample was cut out from each steel wire material and the adhesion of scale was calculated from a weight difference of the sample before and after pickling with hydrochloric acid. The mean value of measurement data on 10 or more steel wire materials was used for the evaluation of scale.

As for the evaluation of tensile characteristics, a 400 mm long sample was cut out from each steel wire material and a tensile test was made on the sample by a universal testing machine at a cross head speed of 10 mm/min and a gauge length of 150 mm. 40 or more steel wire materials were measured to obtain a mean value of the measurement data as tensile strength (TS: MPa) and reduction of area (RA: %).

A description is subsequently given of the evaluation of wire drawability. Descaling and lubricant coating were made on each steel wire material as pre-treatments before wire drawing. For descaling, hydrochloric acid was used to remove scale by pickling. After descaling, the surface of each steel wire material was coated with phosphate as lubricant coating before wire drawing. Thereafter, dry wire drawing was carried out by a continuous wire drawing machine to a final wire diameter of 0.9 mm.

In this experimental example, to improve productivity at the time of wire drawing, wire drawing was carried out under three different conditions: (1) the final wire drawing rate was 600 mm/min and the number of dies was 14, (2) the final wire drawing rate was 800 mm/min and the number of dies was 14, and (3) the final wire drawing rate was 800 m/min and the number of dies was 12.

Although wire drawing productivity becomes higher from the conditions (1) to the conditions (3), wire drawing conditions become more harsh and a steel wire material to be drawn needs higher wire drawability. 50 tons of each steel wire material was drawn under the above three different conditions to evaluate the existence of wire breakage during wire drawing and the service life of each die. As for the evaluation of the service life of the die, when the die is broken during wire drawing, it is evaluated as (X), when the die is not broken during the drawing of 50 tons of the wire material but the die is worn away and must be exchanged for a new one after wire drawing, it is evaluated as (Δ), and when the die does not need to be exchanged due to the breakage and wear of the die after 50 tons of the wire material is drawn, it is evaluated as (○). (-) means that the service life of the die cannot be evaluated due to breakage of the wire.

Figure 4:
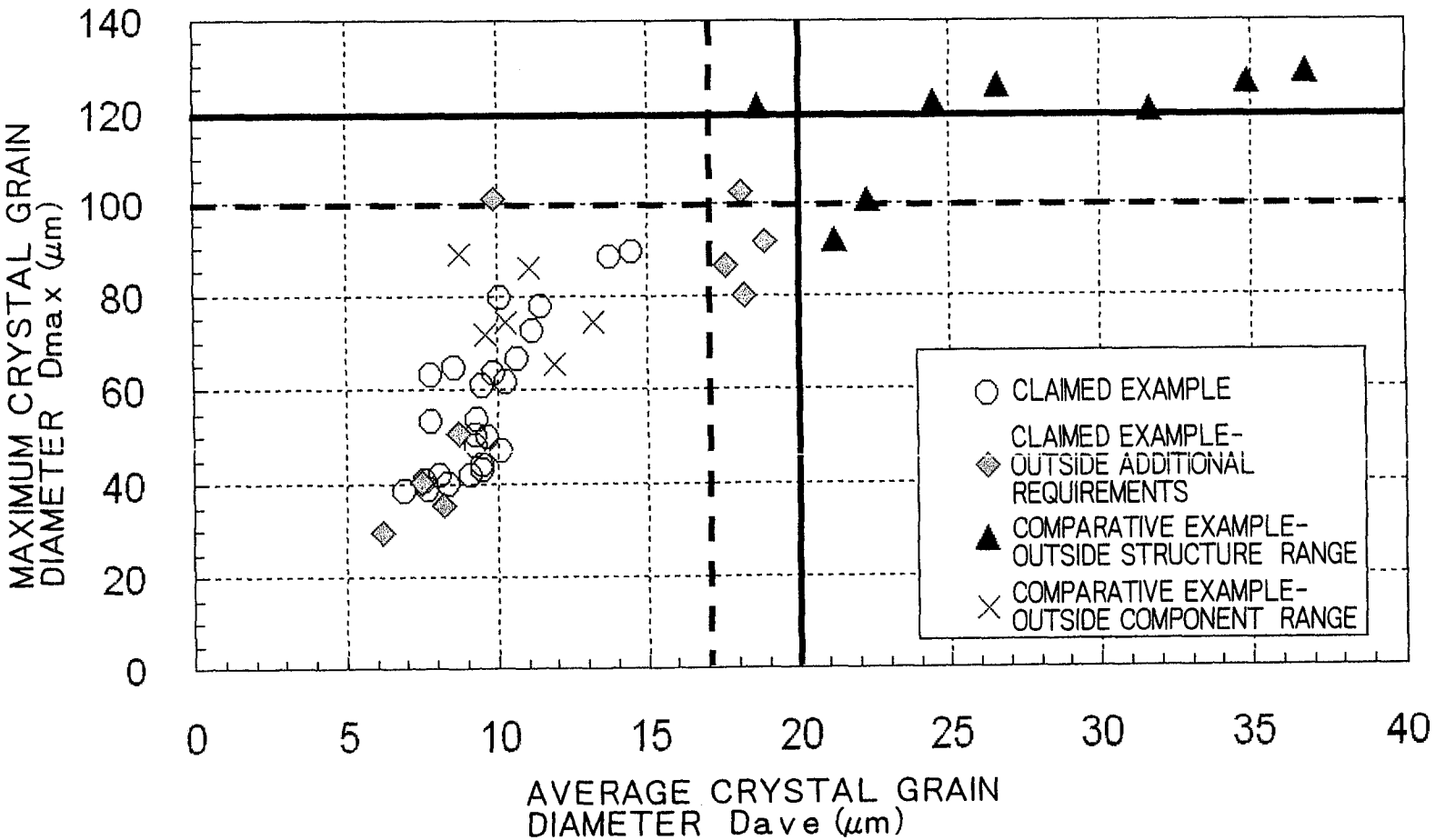
FIG. 4 is a graph showing the influence upon performance of average crystal grain diameter and maximum crystal grain diameter obtained in Experimental Example 1.

The results are shown in Table 4 and FIG. 4.

TABLE 1

| | Composition (mass %) | | | | | | | | | | | (ppm) | | |
|---|---|---|---|---|---|---|---|---|---|---|---|---|---|---|
| Symbol | C | Si | Mn | P | S | Cu | Ni | Cr | Al | N | O | Mg | Ca | REM |
| A1 | 0.62 | 0.21 | 0.52 | 0.008 | 0.016 | 0.01 | 0.01 | 0.01 | 0.0011 | 0.0030 | 0.0011 | 0.1 | 0.4 | — |
| A2 | 0.71 | 0.19 | 0.51 | 0.005 | 0.003 | 0.01 | 0.02 | 0.01 | 0.0012 | 0.0037 | 0.0013 | 0.1 | 1.0 | — |
| A3 | 0.72 | 0.22 | 0.50 | 0.010 | 0.011 | 0.02 | 0.01 | 0.02 | 0.0005 | 0.0024 | 0.0014 | 0.1 | 0.7 | 0.1 |
| A4 | 0.71 | 0.18 | 0.81 | 0.013 | 0.004 | 0.01 | 0.01 | 0.02 | 0.0020 | 0.0026 | 0.0013 | 0.2 | 1.7 | 0.1 |
| A5 | 0.77 | 0.19 | 0.50 | 0.007 | 0.003 | 0.01 | 0.01 | 0.10 | 0.0022 | 0.0031 | 0.0014 | 0.1 | 1.3 | — |
| A6 | 0.81 | 0.22 | 0.51 | 0.006 | 0.005 | 0.01 | 0.01 | 0.01 | 0.0003 | 0.0032 | 0.0012 | 0.1 | 0.9 | 0.2 |
| A7 | 0.80 | 0.20 | 0.51 | 0.006 | 0.007 | 0.01 | 0.01 | 0.02 | 0.0010 | 0.0028 | 0.0013 | 0.1 | 0.7 | — |
| A8 | 0.81 | 0.19 | 0.50 | 0.012 | 0.010 | 0.01 | 0.01 | 0.01 | 0.0020 | 0.0029 | 0.0014 | 0.1 | 0.8 | — |
| A9 | 0.82 | 0.20 | 0.52 | 0.018 | 0.016 | 0.01 | 0.01 | 0.01 | 0.0011 | 0.0034 | 0.0014 | 0.2 | 1.2 | 0.1 |
| A10 | 0.82 | 0.23 | 0.50 | 0.008 | 0.006 | 0.01 | 0.02 | 0.02 | 0.0110 | 0.0042 | 0.0021 | — | — | — |
| A11 | 0.81 | 0.22 | 0.51 | 0.007 | 0.005 | — | — | — | 0.0018 | 0.0019 | 0.0015 | 0.9 | 2.1 | 0.4 |
| A12 | 0.82 | 1.61 | 0.50 | 0.016 | 0.008 | 0.62 | 0.53 | 0.80 | 0.0275 | 0.0051 | 0.0016 | 2.1 | 2.7 | 1.0 |
| A13 | 0.88 | 0.22 | 0.72 | 0.010 | 0.012 | 0.05 | 0.20 | 0.21 | 0.0016 | 0.0034 | 0.0017 | 0.1 | 1.2 | 0.1 |
| A14 | 0.91 | 0.21 | 0.49 | 0.004 | 0.005 | 0.01 | 0.01 | 0.01 | 0.0010 | 0.0026 | 0.0012 | 0.1 | 0.8 | 0.1 |
| A15 | 1.02 | 0.21 | 0.49 | 0.004 | 0.005 | 0.19 | 0.05 | 0.22 | 0.0004 | 0.0028 | 0.0010 | 0.1 | 1.5 | 0.1 |
| A16 | 0.81 | 0.22 | 0.51 | 0.012 | 0.021 | 0.01 | 0.01 | 0.02 | 0.0011 | 0.0033 | 0.0014 | 0.1 | 1.6 | — |
| A17 | 0.81 | 0.22 | 0.51 | 0.022 | 0.012 | 0.01 | 0.01 | 0.01 | 0.0008 | 0.0035 | 0.0017 | 0.2 | 2.1 | 0.1 |
| A18 | 0.81 | 2.21 | 0.50 | 0.007 | 0.008 | 0.01 | 0.01 | 0.01 | 0.0008 | 0.0034 | 0.0014 | 0.1 | 1.3 | 0.1 |
| A19 | 0.80 | 0.19 | 1.49 | 0.009 | 0.010 | 0.01 | 0.01 | 0.01 | 0.0006 | 0.0030 | 0.0013 | 0.1 | 1.3 | — |
| A20 | 0.80 | 0.19 | 0.49 | 0.005 | 0.006 | 0.01 | 0.01 | 0.01 | 0.0022 | 0.0081 | 0.0017 | 0.1 | 0.9 | — |
| A21 | 1.21 | 0.21 | 0.49 | 0.007 | 0.005 | 0.02 | 0.21 | 0.20 | 0.0108 | 0.0044 | 0.0015 | 0.1 | 0.9 | — |

TABLE 2

| No. | Type of steel | heating temperature $T_0$(° C.) | Average cooling rate ° C./SEC | Control temperature 1 $T_1$(° C.) | Average temperature elevation rate ° C./SEC | Control temperature 2 $T_2$(° C.) | Average crystal grain diameter Dave (μm) | Maximum crystal grain diameter Dmax (μm) | Area ratio of crystal grains having a diameter of 80 μm or more AF80 (%) |
|---|---|---|---|---|---|---|---|---|---|
| 1 | A1 | 924 | 31 | 573 | 12 | 641 | 7.8 | 53.4 | 0 |
| 2 | A1 | 924 | 30 | 611 | 11 | 640 | 18.2 | 79.9 | 0 |
| 3 | A2 | 744 | 16 | 581 | 12 | 640 | 6.2 | 29.8 | 0 |
| 4 | A2 | 771 | 49 | 578 | 14 | 641 | 6.9 | 38.8 | 0 |
| 5 | A2 | 923 | 32 | 574 | 14 | 638 | 7.8 | 63.2 | 0 |
| 6 | A3 | 922 | 22 | 612 | 12 | 663 | 14.5 | 89.3 | 21.6 |
| 7 | A3 | 924 | 31 | 642 | Maintaining the same temperature | | 22.3 | 100.7 | 55.2 |
| 8 | A3 | 925 | 30 | 670 | Maintaining the same temperature | | 34.9 | 126.8 | 68.3 |

TABLE 2-continued

| | | | | | | | | | |
|---|---|---|---|---|---|---|---|---|---|
| 9 | A4 | 924 | 32 | 571 | 15 | 640 | 9.5 | 61.0 | 0 |
| 10 | A4 | 951 | 31 | 671 | Left to be gradually cooled | | 31.7 | 120.8 | 60.2 |
| 11 | A5 | 922 | 16 | 572 | 11 | 641 | 11.5 | 77.7 | 0 |
| 12 | A6 | 814 | 28 | 614 | 6 | 677 | 9.3 | 53.9 | 0 |
| 13 | A6 | 852 | 34 | 579 | 10 | 634 | 8.4 | 40.1 | 0 |
| 14 | A6 | 851 | 32 | 628 | 5 | 678 | 9.9 | 101.0 | 39.8 |
| 15 | A6 | 922 | 31 | 572 | 20 | 641 | 10.1 | 79.3 | 0 |
| 16 | A7 | 924 | 29 | 588 | 48 | 681 | 13.8 | 88.1 | 23.2 |
| 17 | A7 | 951 | 11 | 612 | 11 | 678 | 21.2 | 91.8 | 46.7 |
| 18 | A7 | 950 | 31 | 609 | 10 | 681 | 17.6 | 86.2 | 40.6 |
| 19 | A8 | 974 | 32 | 538 | 12 | 605 | 10.7 | 66.3 | 0 |
| 20 | A8 | 977 | 87 | 561 | 22 | 701 | 9.5 | 44.2 | 0 |
| 21 | A8 | 970 | 92 | 562 | 25 | 713 | 10.1 | 47.1 | 0 |
| 22 | A8 | 970 | 112 | 558 | 25 | 707 | 9.3 | 50.4 | 0 |
| 23 | A8 | 975 | 31 | 642 | 11 | 668 | 26.6 | 125.8 | 67.9 |
| 24 | A9 | 974 | 33 | 637 | 11 | 679 | 18.1 | 102.4 | 41.2 |

| No. | Average sub grain diameter dave (μm) | Maximum sub grain diameter dmax (μm) | Crystal grain diameter/Sub grain diameter ratio Dave/dave | Total decarbon-ization $D_{m \cdot T}$ (μm) | Adhesion of scale mass % | Tensile strength TS (Mpa) | TS ≦ 1240 × $Wc^{0.52}$ | Reduction of area RA (%) | Remarks |
|---|---|---|---|---|---|---|---|---|---|
| 1 | 4.3 | 24.3 | 1.8 | 38 | 0.599 | 961 | | 55 | |
| 2 | 10.3 | 51.7 | 1.8 | 41 | 0.567 | 950 | ○ | 51 | |
| 3 | 3.0 | 13.5 | 2.1 | 48 | 0.132 | 974 | ○ | 49 | Descalability: Δ |
| 4 | 3.2 | 17.7 | 2.2 | 53 | 0.189 | 991 | ○ | 52 | |
| 5 | 2.8 | 23.2 | 2.8 | 63 | 0.597 | 1007 | ○ | 45 | |
| 6 | 5.1 | 34.2 | 2.8 | 62 | 0.580 | 998 | ○ | 41 | |
| 7 | 5.3 | 46.7 | 4.2 | 57 | 0.554 | 1002 | ○ | 30 | |
| 8 | 7.6 | 51.1 | 4.6 | 55 | 0.543 | 987 | ○ | 28 | |
| 9 | 4.2 | 24.5 | 2.3 | 47 | 0.611 | 1011 | ○ | 47 | |
| 10 | 6.2 | 47.2 | 5.1 | 52 | 0.557 | 992 | ○ | 28 | |
| 11 | 4.6 | 26.2 | 2.5 | 46 | 0.583 | 1036 | ○ | 46 | |
| 12 | 4.5 | 27.6 | 2.1 | 40 | 0.293 | 1023 | ○ | 41 | |
| 13 | 3.1 | 18.1 | 2.7 | 52 | 0.338 | 1031 | ○ | 43 | |
| 14 | 4.6 | 23.8 | 2.2 | 41 | 0.280 | 1010 | ○ | 39 | |
| 15 | 4.2 | 28.8 | 2.4 | 38 | 0.588 | 1032 | ○ | 39 | |
| 16 | 4.7 | 33.3 | 2.9 | 48 | 0.522 | 1018 | ○ | 36 | |
| 17 | 5.6 | 36.1 | 3.8 | 56 | 0.610 | 1005 | ○ | 32 | |
| 18 | 5.5 | 38.2 | 3.2 | 54 | 0.634 | 1008 | ○ | 35 | |
| 19 | 3.7 | 19.7 | 2.9 | 61 | 0.821 | 1051 | ○ | 40 | |
| 20 | 4.2 | 21.0 | 2.3 | 58 | 0.757 | 1002 | ○ | 38 | |
| 21 | 4.8 | 23.5 | 2.1 | 52 | 0.702 | 997 | ○ | 35 | |
| 22 | 4.7 | 22.3 | 2.0 | 55 | 0.690 | 1010 | ○ | 39 | |
| 23 | 7.0 | 50.8 | 3.8 | 62 | 0.678 | 1002 | ○ | 31 | |
| 24 | 6.2 | 40.1 | 2.9 | 66 | 0.699 | 1010 | ○ | 35 | |

TABLE 3

| No. | Type of steel | heating temperature $T_0$(° C.) | Average cooling rate ° C./SEC | Control temperature 1 $T_1$(° C.) | Average temperature elevation rate ° C./SEC | Control temperature 2 $T_2$(° C.) | Average crystal grain diameter Dave (μm) | Maximum crystal grain diameter Dmax (μm) | Area ratio of crystal grains having a diameter of 80 μm or more AF80 (%) |
|---|---|---|---|---|---|---|---|---|---|
| 25 | A9 | 976 | 29 | 641 | Left to be gradually cooled | | 18.7 | 121.4 | 62.2 |
| 26 | A9 | 976 | 31 | 641 | Maintaining the same temperature | | 24.5 | 122.1 | 66.3 |
| 27 | A9 | 975 | 29 | 670 | Maintaining the same temperature | | 36.8 | 128.9 | 70.8 |
| 28 | A10 | 822 | 48 | 577 | 7 | 642 | 9.5 | 43.2 | 0 |
| 29 | A10 | 821 | 46 | 522 | 15 | 576 | 7.5 | 40.6 | 0 |
| 30 | A10 | 951 | 47 | 531 | 10 | 551 | 8.7 | 50.8 | 0 |
| 31 | A11 | 848 | 47 | 521 | 43 | 638 | 7.6 | 41.0 | 0 |
| 32 | A12 | 947 | 19 | 559 | 21 | 637 | 11.2 | 72.4 | 0 |
| 33 | A13 | 848 | 39 | 578 | 8 | 641 | 8.1 | 42.1 | 0 |
| 34 | A13 | 924 | 38 | 580 | 9 | 642 | 9.9 | 63.4 | 0 |
| 35 | A14 | 850 | 67 | 578 | 10 | 644 | 7.7 | 39.0 | 0 |
| 36 | A14 | 882 | 54 | 581 | 19 | 640 | 9.1 | 42.1 | 0 |
| 37 | A14 | 923 | 71 | 577 | 10 | 643 | 10.3 | 61.7 | 0 |
| 38 | A14 | 921 | 99 | 558 | 20 | 698 | 9.7 | 50.1 | 0 |
| 39 | A14 | 920 | 98 | 552 | 22 | 680 | 9.3 | 48.2 | 0 |
| 40 | A14 | 950 | 47 | 488 | 22 | 601 | 8.2 | 35.5 | 0 |
| 41 | A14 | 1021 | 70 | 581 | 12 | 644 | 18.9 | 91.3 | 42.5 |
| 42 | A15 | 924 | 68 | 558 | 19 | 640 | 8.6 | 64.6 | 0 |

TABLE 3-continued

| | | | | | | | | | |
|---|---|---|---|---|---|---|---|---|---|
| 43 | A16 | 925 | 29 | 581 | 24 | 639 | 10.3 | 74.4 | 0 |
| 44 | A17 | 923 | 30 | 576 | 24 | 638 | 11.1 | 85.7 | 12.7 |
| 45 | A18 | 930 | 30 | 573 | 25 | 641 | 9.6 | 71.5 | 0 |
| 46 | A19 | 924 | 28 | 579 | 22 | 637 | 8.8 | 88.8 | 18.6 |
| 47 | A20 | 924 | 29 | 577 | 24 | 639 | 13.2 | 74.3 | 0 |
| 48 | A21 | 924 | 30 | 575 | 24 | 639 | 11.9 | 65.2 | |

| No. | Average sub grain diameter dave (μm) | Maximum sub grain diameter dmax (μm) | Crystal grain diameter/Sub grain diameter ratio Dave/dave | Total decarbon-ization $D_{m \cdot T}$ (μm) | Adhesion of scale mass % | Tensile strength TS (Mpa) | TS < 1240 × Wc0.52 | Reduction of area RA (%) | Remarks |
|---|---|---|---|---|---|---|---|---|---|
| 25 | 5.1 | 42.4 | 3.7 | 66 | 0.761 | 1025 | ○ | 34 | |
| 26 | 5.8 | 46.0 | 4.2 | 65 | 0.720 | 1011 | ○ | 32 | |
| 27 | 8.2 | 52.0 | 4.5 | 67 | 0.751 | 979 | ○ | 27 | |
| 28 | 3.3 | 20.2 | 2.9 | 53 | 0.314 | 1031 | ○ | 45 | |
| 29 | 2.0 | 13.7 | 3.8 | 48 | 0.298 | 1121 | X | 39 | |
| 30 | 1.8 | 14.4 | 4.8 | 55 | 0.570 | 1131 | X | 37 | |
| 31 | 3.2 | 17.6 | 2.4 | 47 | 0.326 | 1027 | ○ | 41 | |
| 32 | 4.4 | 31.1 | 2.5 | 83 | 0.559 | 1082 | ○ | 44 | |
| 33 | 3.6 | 22.5 | 2.3 | 45 | 0.322 | 1109 | ○ | 39 | |
| 34 | 3.7 | 24.1 | 2.7 | 46 | 0.533 | 1121 | ○ | 38 | |
| 35 | 2.9 | 17.1 | 2.7 | 42 | 0.313 | 1119 | ○ | 37 | |
| 36 | 3.1 | 20.2 | 2.9 | 49 | 0.431 | 1130 | ○ | 38 | |
| 37 | 2.8 | 18.2 | 3.7 | 51 | 0.498 | 1142 | ○ | 39 | |
| 38 | 3.8 | 27.2 | 2.6 | 55 | 0.452 | 1079 | ○ | 36 | |
| 39 | 3.5 | 23.2 | 2.7 | 54 | 0.459 | 1096 | ○ | 36 | |
| 40 | 2.1 | 17.5 | 3.9 | 56 | 0.523 | 1191 | X | 40 | |
| 41 | 4.7 | 34.9 | 4.0 | 75 | 0.910 | 1155 | ○ | 40 | Rust on surface layer: existent |
| 42 | 2.7 | 17.4 | 3.2 | 61 | 0.501 | 1240 | ○ | 38 | |
| 43 | 4.3 | 27.3 | 2.4 | 40 | 0.565 | 1041 | ○ | 32 | |
| 44 | 3.8 | 25.6 | 2.9 | 47 | 0.519 | 1038 | ○ | 31 | |
| 45 | 4.1 | 25.9 | 2.3 | 124 | 0.522 | 1120 | X | 40 | Descalability: x |
| 46 | 2.8 | 19.7 | 3.1 | 32 | 0.551 | 1223 | X | 38 | Supercooling structure: existence |
| 47 | 4.2 | 26.5 | 3.1 | 42 | 0.509 | 1081 | ○ | 31 | |
| 48 | 2.4 | 19.2 | 5.0 | 62 | 0.574 | 1331 | ○ | 32 | |

TABLE 4

| | Wire drawing condition (1) | | Wire drawing condition (2) | | Wire drawing condition (3) | |
|---|---|---|---|---|---|---|
| No. | Existence of wire breakage | Service life of die | Existence of wire breakage | Service life of die | Existence of wire breakage | Service life of die |
| 1 | Non-existence | ○ | Non-existence | ○ | Non-existence | ○ |
| 2 | Non-existence | ○ | Non-existence | ○ | Existence | — |
| 3 | Non-existence | Δ | Non-existence | Δ | Non-existence | Δ |
| 4 | Non-existence | ○ | Non-existence | ○ | Non-existence | ○ |
| 5 | Non-existence | ○ | Non-existence | ○ | Non-existence | ○ |
| 6 | Non-existence | ○ | Non-existence | ○ | Non-existence | ○ |
| 7 | Existence | — | Existence | — | Existence | — |
| 8 | Existence | — | Existence | — | Existence | — |
| 9 | Non-existence | ○ | Non-existence | ○ | Non-existence | ○ |
| 10 | Existence | — | Existence | — | Existence | — |
| 11 | Non-existence | ○ | Non-existence | ○ | Non-existence | ○ |
| 12 | Non-existence | ○ | Non-existence | ○ | Non-existence | ○ |
| 13 | Non-existence | ○ | Non-existence | ○ | Non-existence | ○ |
| 14 | Non-existence | ○ | Non-existence | ○ | Non-existence | ○ |
| 15 | Non-existence | ○ | Non-existence | ○ | Non-existence | ○ |
| 16 | Non-existence | ○ | Non-existence | ○ | Non-existence | ○ |
| 17 | Existence | — | Existence | — | Existence | — |
| 18 | Non-existence | ○ | Non-existence | ○ | Existence | — |
| 19 | Non-existence | ○ | Non-existence | ○ | Non-existence | ○ |
| 20 | Non-existence | ○ | Non-existence | ○ | Non-existence | ○ |
| 21 | Non-existence | ○ | Non-existence | ○ | Non-existence | ○ |
| 22 | Non-existence | ○ | Non-existence | ○ | Non-existence | ○ |
| 23 | Existence | — | Existence | — | Existence | — |
| 24 | Non-existence | ○ | Non-existence | ○ | Existence | — |
| 25 | Existence | — | Existence | — | Existence | — |

TABLE 4-continued

| No. | Wire drawing condition (1) Existence of wire breakage | Wire drawing condition (1) Service life of die | Wire drawing condition (2) Existence of wire breakage | Wire drawing condition (2) Service life of die | Wire drawing condition (3) Existence of wire breakage | Wire drawing condition (3) Service life of die |
|---|---|---|---|---|---|---|
| 26 | Existence | — | Existence | — | Existence | — |
| 27 | Existence | — | Existence | — | Existence | — |
| 28 | Non-existence | ○ | Non-existence | ○ | Non-existence | ○ |
| 29 | Non-existence | Δ | Non-existence | Δ | Existence | — |
| 30 | Non-existence | Δ | Non-existence | Δ | Existence | — |
| 31 | Non-existence | ○ | Non-existence | ○ | Non-existence | ○ |
| 32 | Non-existence | ○ | Non-existence | ○ | Non-existence | ○ |
| 33 | Non-existence | ○ | Non-existence | ○ | Non-existence | ○ |
| 34 | Non-existence | ○ | Non-existence | ○ | Non-existence | ○ |
| 35 | Non-existence | ○ | Non-existence | ○ | Non-existence | ○ |
| 36 | Non-existence | ○ | Non-existence | ○ | Non-existence | ○ |
| 37 | Non-existence | ○ | Non-existence | ○ | Non-existence | ○ |
| 38 | Non-existence | ○ | Non-existence | ○ | Non-existence | ○ |
| 39 | Non-existence | ○ | Non-existence | ○ | Non-existence | ○ |
| 40 | Non-existence | Δ | Non-existence | Δ | Existence | — |
| 41 | Non-existence | ○ | Non-existence | ○ | Existence | — |
| 42 | Non-existence | ○ | Non-existence | ○ | Non-existence | ○ |
| 43 | Existence | — | Existence | — | Existence | — |
| 44 | Existence | — | Existence | — | Existence | — |
| 45 | Non-existence | X | Existence | — | Existence | — |
| 46 | Existence | — | Existence | — | Existence | — |
| 47 | Existence | — | Existence | — | Existence | — |
| 48 | Existence | — | Existence | — | Existence | — |

The following can be analyzed as follows from Tables 1 to 4.

Wire drawability is improved by controlling the average crystal grain diameter ($D_{ave}$) to 20 μm or less and the maximum crystal grain diameter ($D_{max}$) to 120 μm or less as shown in FIG. 4. Therefore, even when the wire drawing rate is increased, high-speed wire drawing is made possible without breaking the wire material. Further, when the structure is made uniform and fine by controlling ($D_{ave}$) to 17 μm or less and ($D_{max}$) to 100 μm or less; TS is reduced to $1{,}240\times Wc^{0.52}$ or less; the average sub grain diameter ($d_{ave}$) is controlled to 10 μm or less; the maximum sub grain diameter ($d_{max}$) is controlled to 50 μm or less; and the ($D_{ave}/d_{ave}$) ratio is controlled to 4.5 or less as additional requirements, wire drawing is made possible without wire breakage even if the number of dies is reduced and the wire drawing rate is increased. Consequently, wire drawability can be further improved.

Steel wire materials Nos. 2, 14, 18, 24, 29, 30, 40 and 41 which satisfy the requirements for the average crystal grail diameter ($D_{ave}$) and the maximum crystal grain diameter ($D_{max}$) but not the above additional requirements are broken when the number of dies is small though high-speed wire drawing is possible. In case of steel wire material No. 3 in Tables 2 to 4 which is inferior in descalability from the viewpoint of the service life of the die, wire breakage does not occur during wire drawing even when wire drawing conditions acre made harsh but a bad influence upon the service life of the die is seen to such an extent that the die must be exchanged after wire drawing. Also in case of steel wire materials Nos. 29, 30 and 40 in Tables 2 to 4 which are unsatisfactory in the softening of steel and do not satisfy "$TS\leqq 1240\times Wc^{0.52}$", the service life of the die is short.

The influence upon wire drawability of the composition appears in steel wire materials Nos. 43 to 48 in Tables 3 and 4. That is, as A16 and A17 which are used in steel wire materials Nos. 43 and 44 of Tables 3 and 4 have high contents of P and S, wire breakage occurs though their metal structures are suitably controlled. Since A18 which is used in steel wire material No. 45 of Tables 3 and 4 contains Si too much, marked decarbonization occurs, descalability is poor and strength is too high, thereby causing the breakage of the die and wire breakage during wire drawing.

As A19 used in the steel wire material No. 46 of Tables 3 and 4 contains Mn too much, a supercooling structure is formed and strength is high. Since A20 of steel wire material No. 47 contains N too much, ductility becomes unsatisfactory and strain aging embrittlement readily occurs during wire drawing. Since A21 of steel wire material No. 48 contains C more than the specified value, its ductility is poor and strain aging embrittlement readily occurs during wire drawing.

A steel wire material whose steel components are outside the specified range of the present invention does not achieve satisfactory wire drawability though it has the structural features of the present invention.

Experimental Example 2

To improve wire drawability as hot rolled, types of steel shown in Table 5 below were used and studied. The amount of REM in Table 5 shows the total amount of La, Ce, Pr and Nd. All the types of steel shown in Table 5 satisfy the requirements for composition specified by the present invention.

Figure 5:
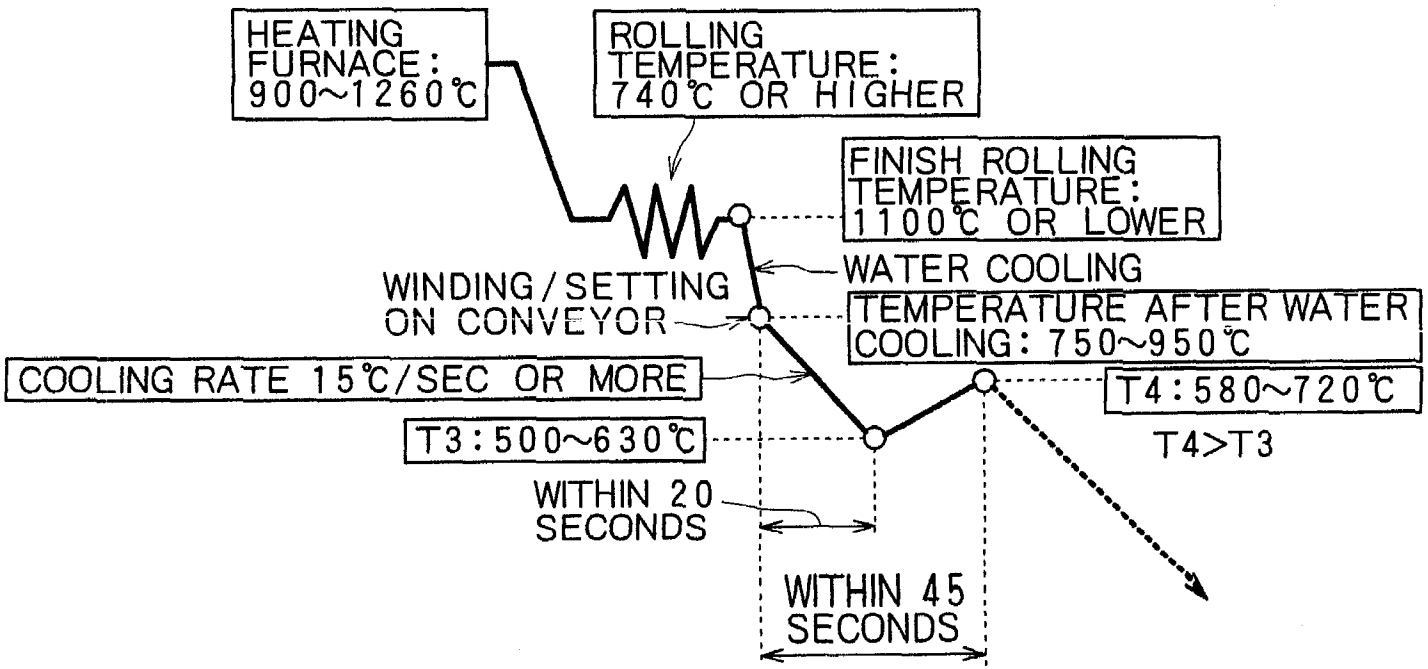
FIG. 5 is a schematic diagram of a production pattern employed in Experimental Example 2.

The types of steel shown in Table 5 were hot rolled under conditions shown in Table 6 and FIG. 5. In the case of a hot rolled material, all the steps from a heating furnace to rolling and cooling must be controlled. As shown in FIG. 5, the control items are more complicated than in the above Experimental Example 1 (FIG. 1). The structural features, scale characteristics, tensile characteristics and wire drawability of the obtained hot rolled materials were evaluated in the same manner as in the above Experimental Example 1.

Figure 6:
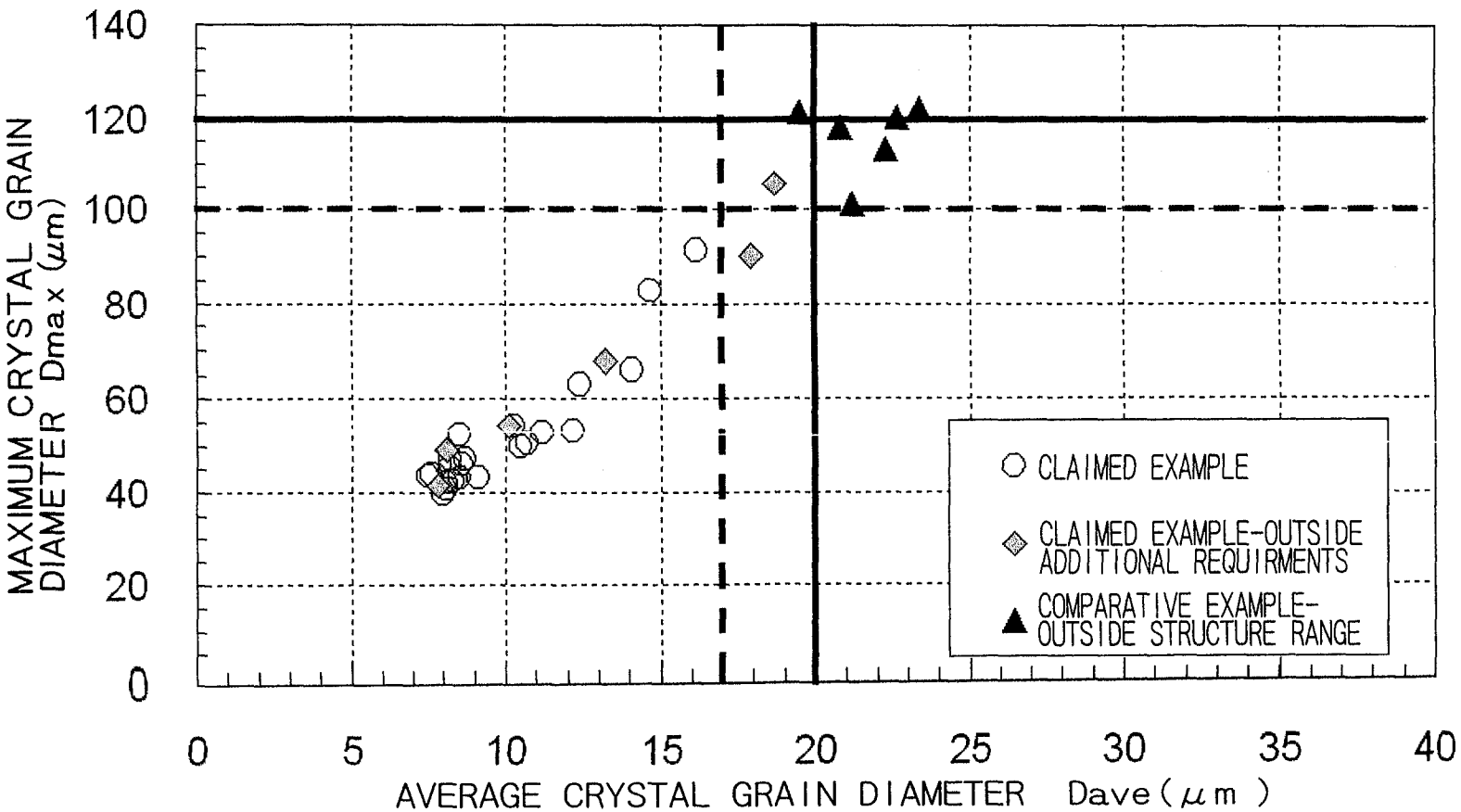
FIG. 6 is a graph showing the influence upon performance of average crystal grain diameter and maximum crystal grain diameter obtained in Experimental Example 2.

The results are shown in Tables 6 to 8 and FIG. 6. By suitably controlling a series of steps from heating to winding and cooling for hot rolling, the structural features, scale characteristics and tensile characteristics can be controlled to the ranges specified by the present invention as well, and it can be confirmed from the results of the evaluation of wire drawability that excellent wire drawability can be obtained as the wire material is hot rolled.

TABLE 5

| Symbol | Composition (Mass %) | | | | | | | | | | | (ppm) | | |
|---|---|---|---|---|---|---|---|---|---|---|---|---|---|---|
| | C | Si | Mn | P | S | Cu | Ni | Cr | Al | N | O | Mg | Ca | REM |
| B1 | 0.61 | 0.20 | 0.51 | 0.009 | 0.012 | 0.01 | 0.01 | 0.02 | 0.0008 | 0.0032 | 0.0013 | 0.1 | 0.7 | — |
| B2 | 0.71 | 0.21 | 0.48 | 0.004 | 0.005 | 0.01 | 0.01 | 0.01 | 0.0010 | 0.0030 | 0.0013 | 0.1 | 1.2 | — |
| B3 | 0.72 | 0.20 | 0.88 | 0.008 | 0.010 | 0.01 | 0.01 | 0.01 | 0.0009 | 0.0028 | 0.0014 | 0.2 | 1.4 | 0.2 |
| B4 | 0.72 | 0.19 | 0.83 | 0.006 | 0.005 | 0.01 | 0.02 | — | 0.0278 | 0.0032 | 0.0013 | — | — | — |
| B5 | 0.77 | 0.20 | 0.50 | 0.006 | 0.005 | 0.19 | 0.01 | 0.20 | 0.0022 | 0.0031 | 0.0014 | 0.1 | 1.3 | — |
| B6 | 0.80 | 0.21 | 0.52 | 0.005 | 0.004 | 0.01 | 0.01 | 0.01 | 0.0004 | 0.0032 | 0.0013 | 0.1 | 0.8 | — |
| B7 | 0.81 | 0.20 | 0.51 | 0.006 | 0.006 | 0.01 | 0.01 | 0.01 | 0.0005 | 0.0030 | 0.0014 | 0.1 | 1.0 | — |
| B8 | 0.82 | 0.21 | 0.51 | 0.006 | 0.007 | 0.01 | 0.01 | 0.02 | 0.0003 | 0.0029 | 0.0014 | 0.1 | 1.2 | — |
| B9 | 0.88 | 0.25 | 0.79 | 0.010 | 0.007 | 0.20 | 0.02 | 0.22 | 0.0311 | 0.0047 | 0.0015 | 0.1 | 0.6 | 0.1 |
| B10 | 0.89 | 0.92 | 0.72 | 0.011 | 0.008 | 0.01 | 0.01 | 0.25 | 0.0306 | 0.0041 | 0.0014 | 0.1 | 1.0 | — |
| B11 | 0.91 | 0.19 | 0.50 | 0.005 | 0.004 | 0.19 | 0.02 | 0.20 | 0.0007 | 0.0027 | 0.0013 | 0.1 | 0.8 | — |
| B12 | 0.92 | 0.19 | 0.49 | 0.004 | 0.005 | 0.18 | — | 0.20 | 0.0006 | 0.0027 | 0.0011 | — | 1.0 | 0.1 |
| B13 | 1.07 | 0.21 | 0.51 | 0.006 | 0.006 | 0.21 | 0.01 | 0.21 | 0.0005 | 0.0028 | 0.0012 | 0.2 | 1.3 | 0.1 |

TABLE 6

| No. | Type of steel | Temperature of heating furnace ° C. | Lowest rolling temperature ° C. | Finish rolling temperature ° C. | Temperature after water cooling ° C. | Average cooling rate ° C./SEC | Control temperature 1 | | Control temperature 2 | | Average crystal grain diameter Dave(μm) | Maximum crystal grain diameter Dmax(μm) |
|---|---|---|---|---|---|---|---|---|---|---|---|---|
| | | | | | | | Time from setting SEC | Temperature $T_3$(° C.) | Time for setting SEC | Temperature $T_4$(° C.) | | |
| 1 | B1 | 1152 | 902 | 984 | 852 | 17 | 16 | 580 | 28 | 640 | 8.2 | 45.4 |
| 2 | B1 | 1151 | 948 | 1027 | 847 | 21 | 13 | 574 | 27 | 644 | 8.7 | 47.2 |
| 3 | B1 | 1147 | 955 | 1031 | 922 | 17 | 16 | 650 | 39 | 696 | 23.4 | 122.1 |
| 4 | B2 | 1151 | 835 | 932 | 902 | 35 | 9 | 587 | 31 | 653 | 8.5 | 43.2 |
| 5 | B2 | 1150 | 911 | 979 | 910 | 31 | 11 | 569 | 30 | 645 | 10.3 | 54.3 |
| 6 | B2 | 1148 | 942 | 1031 | 901 | 37 | 9 | 568 | 33 | 676 | 14.1 | 65.8 |
| 7 | B2 | 1147 | 937 | 1025 | 899 | 13 | 19 | 652 | 34 | 667 | 22.7 | 120.2 |
| 8 | B3 | 1102 | 822 | 912 | 823 | 29 | 10 | 533 | 28 | 623 | 8.5 | 52.5 |
| 9 | B3 | 1110 | 824 | 920 | 900 | 53 | 7 | 529 | 27 | 629 | 8.1 | 49.2 |
| 10 | B4 | 1152 | 932 | 1022 | 905 | 55 | 6 | 575 | 20 | 645 | 8.2 | 47.3 |
| 11 | B4 | 1154 | 938 | 1031 | 912 | 97 | 4 | 573 | 12 | 599 | 8.1 | 42.1 |
| 12 | B4 | 1150 | 935 | 1027 | 907 | 109 | 3 | 580 | 13 | 630 | 7.5 | 43.5 |
| 13 | B5 | 1012 | 802 | 908 | 823 | 24 | 11 | 559 | 22 | 625 | 8.6 | 46.1 |
| 14 | B5 | 1022 | 743 | 851 | 822 | 25 | 11 | 547 | 24 | 625 | 7.8 | 41.4 |
| 15 | B6 | 973 | 808 | 901 | 844 | 37 | 8 | 548 | 23 | 638 | 8.3 | 42.5 |
| 16 | B6 | 1102 | 854 | 944 | 863 | 42 | 8 | 527 | 22 | 597 | 9.1 | 43.1 |
| 17 | B6 | 1102 | 883 | 1012 | 882 | 41 | 8 | 554 | 23 | 644 | 10.7 | 50.5 |
| 18 | B7 | 1149 | 822 | 943 | 914 | 17 | 17 | 625 | 28 | 664 | 14.7 | 82.8 |
| 19 | B7 | 1150 | 905 | 987 | 913 | 16 | 18 | 625 | 27 | 659 | 17.9 | 90.1 |
| 20 | B7 | 1155 | 933 | 1045 | 903 | 12 | 22 | 639 | 27 | 669 | 22.3 | 113.4 |
| 21 | B7 | 1152 | 940 | 1044 | 900 | 71 | 5 | 545 | 27 | 699 | 7.6 | 44.0 |
| 22 | B7 | 1150 | 935 | 955 | 911 | 115 | 3 | 566 | 24 | 711 | 8.0 | 39.5 |
| 23 | B8 | 1222 | 989 | 1077 | 925 | 22 | 17 | 551 | 36 | 608 | 12.4 | 63.2 |
| 24 | B8 | 1231 | 987 | 1063 | 932 | 22 | 19 | 514 | 42 | 583 | 10.1 | 54.2 |
| 25 | B8 | 1256 | 992 | 1080 | 931 | 24 | 16 | 547 | 36 | 607 | 13.2 | 67.7 |
| 26 | B8 | 1226 | 995 | 1112 | 973 | 23 | 16 | 605 | 35 | 662 | 21.2 | 101.2 |
| 27 | B9 | 1148 | 931 | 989 | 808 | 21 | 9 | 619 | 27 | 682 | 16.2 | 91.4 |
| 28 | B9 | 1152 | 923 | 974 | 912 | 17 | 16 | 640 | 42 | 679 | 19.5 | 121.3 |
| 29 | B10 | 1155 | 927 | 978 | 802 | 22 | 11 | 560 | 28 | 645 | 10.5 | 49.7 |
| 30 | B11 | 1152 | 932 | 982 | 801 | 21 | 11 | 570 | 31 | 670 | 11.2 | 52.9 |
| 31 | B11 | 1151 | 921 | 979 | 898 | 16 | 16 | 642 | 38 | 664 | 20.8 | 117.9 |
| 32 | B12 | 1151 | 977 | 1046 | 922 | 47 | 7 | 593 | 17 | 701 | 18.7 | 105.5 |
| 33 | B12 | 1150 | 973 | 1040 | 853 | 99 | 3 | 556 | 23 | 706 | 8.1 | 40.8 |
| 34 | B13 | 1148 | 929 | 984 | 872 | 28 | 11 | 564 | 32 | 669 | 12.2 | 53.1 |

TABLE 7

| No. | Type of Steel | Area ratio of crystal grains having a diameter of 80 μm or more AF80 (%) | Average sub grain diameter dave/μm | Maximum sub grain diameter dmax(μm) | Crystal grain diameter/ Sub grain diameter ratio Dave/dave | Total decarbonization $D_{m \cdot T}$(μm) | Adhesion of scale mass % | Tensile strength TS (MPa) | Reduction of area RA(%) | Remarks |
|---|---|---|---|---|---|---|---|---|---|---|
| 1 | B1 | 0 | 5.2 | 24.3 | 1.6 | 62 | 0.389 | 948 | 54 | |
| 2 | B1 | 0 | 5.4 | 27.6 | 1.6 | 71 | 0.375 | 951 | 52 | |
| 3 | B1 | 61.1 | 11.4 | 50.2 | 2.1 | 65 | 0.721 | 930 | 46 | |
| 4 | B2 | 0 | 4.3 | 25.2 | 2.0 | 73 | 0.577 | 998 | 48 | |

TABLE 7-continued

| No. | Type of Steel | Area ratio of crystal grains having a diameter of 80 μm or more AF80 (%) | Average sub grain diameter dave/μm | Maximum sub grain diameter dmax(μm) | Crystal grain diameter/ Sub grain diameter ratio Dave/dave | Total decarbonization $D_{m \cdot T}$(μm) | Adhesion of scale mass % | Tensile strength TS (MPa) | Reduction of area RA(%) | Remarks |
|---|---|---|---|---|---|---|---|---|---|---|
| 5 | B2 | 0 | 4.5 | 25.9 | 2.3 | 65 | 0.592 | 1008 | 50 | |
| 6 | B2 | 0 | 5.1 | 27.7 | 2.8 | 66 | 0.565 | 982 | 48 | |
| 7 | B2 | 58.7 | 10.6 | 48.7 | 2.1 | 67 | 0.534 | 967 | 42 | |
| 8 | B3 | 0 | 4.5 | 26.1 | 1.9 | 54 | 0.298 | 1012 | 46 | |
| 9 | B3 | 0 | 2.9 | 22.4 | 2.8 | 57 | 0.552 | 1046 | 45 | |
| 10 | B4 | 0 | 3.4 | 32.1 | 2.4 | 65 | 0.501 | 1002 | 35 | |
| 11 | B4 | 0 | 5.1 | 29.8 | 1.6 | 69 | 0.450 | 1030 | 38 | |
| 12 | B4 | 0 | 6.2 | 30.7 | 1.2 | 64 | 0.469 | 1007 | 37 | |
| 13 | B5 | 0 | 3.3 | 21.6 | 2.6 | 71 | 0.287 | 1052 | 43 | |
| 14 | B5 | 0 | 3.4 | 20.5 | 2.3 | 103 | 0.256 | 1048 | 42 | DESCALABILITY: Δ |
| 15 | B6 | 0 | 3.5 | 23.3 | 2.4 | 43 | 0.334 | 1027 | 40 | |
| 16 | B6 | 0 | 2.6 | 20.1 | 3.5 | 61 | 0.422 | 1078 | 42 | |
| 17 | B6 | 0 | 2.8 | 21.0 | 3.8 | 63 | 0.498 | 1031 | 40 | |
| 18 | B7 | 24.7 | 6.3 | 34.2 | 2.3 | 65 | 0.621 | 1017 | 37 | |
| 19 | B7 | 40.9 | 7.2 | 35.3 | 2.5 | 67 | 0.613 | 1006 | 36 | |
| 20 | B7 | 52.2 | 7.6 | 37.8 | 2.9 | 62 | 0.603 | 1005 | 33 | |
| 21 | B7 | 0 | 2.9 | 22.7 | 2.6 | 55 | 0.522 | 1002 | 34 | |
| 22 | B7 | 0 | 3.2 | 29.1 | 2.5 | 58 | 0.551 | 998 | 34 | |
| 23 | B8 | 0 | 5.3 | 23.8 | 2.3 | 89 | 0.778 | 1059 | 41 | |
| 24 | B8 | 0 | 3.2 | 24.1 | 3.2 | 91 | 0.812 | 1110 | 43 | |
| 25 | B8 | 0 | 5.1 | 25.2 | 2.6 | 113 | 0.781 | 1050 | 39 | DESCALABILITY: Δ |
| 26 | B8 | 50.9 | 7.9 | 40.1 | 2.7 | 92 | 0.911 | 1011 | 33 | |
| 27 | B9 | 37.5 | 9.3 | 43.2 | 1.7 | 60 | 0.235 | 1110 | 35 | |
| 28 | B9 | 58.6 | 10.2 | 47.8 | 1.9 | 58 | 0.619 | 1102 | 29 | |
| 29 | B10 | 0 | 3.2 | 23.5 | 3.3 | 72 | 0.211 | 1121 | 36 | |
| 30 | B11 | 0 | 3.5 | 31.6 | 3.2 | 65 | 0.254 | 1107 | 36 | |
| 31 | B11 | 55.1 | 6.5 | 47.6 | 3.2 | 59 | 0.604 | 1107 | 28 | |
| 32 | B12 | 48.3 | 9.2 | 43.6 | 2.0 | 64 | 0.645 | 1090 | 31 | |
| 33 | B12 | 0 | 2.9 | 20.0 | 2.8 | 60 | 0.352 | 1068 | 34 | |
| 34 | B13 | 0 | 3.3 | 33.2 | 3.7 | 68 | 0.510 | 1213 | 35 | |

TABLE 8

| | Wire drawing condition1 600 m/min | | Wire drawing condition2 800 m/min | | Wire drawing condition3 (number of dies is reduced) 800 m/min | |
|---|---|---|---|---|---|---|
| No. | Existence of disconnection | Service life of die | Existence of disconnection | Service life of die | Existence of disconnection | Service life of die |
| 1 | Non-existence | ○ | Non-existence | ○ | Non-existence | ○ |
| 2 | Non-existence | ○ | Non-existence | ○ | Non-existence | ○ |
| 3 | Existence | — | Existence | — | Existence | — |
| 4 | Non-existence | ○ | Non-existence | ○ | Non-existence | ○ |
| 5 | Non-existence | ○ | Non-existence | ○ | Non-existence | ○ |
| 6 | Non-existence | ○ | Non-existence | ○ | Non-existence | ○ |
| 7 | Existence | — | Existence | — | Existence | — |
| 8 | Non-existence | ○ | Non-existence | ○ | Non-existence | ○ |
| 9 | Non-existence | Δ | Non-existence | Δ | Existence | — |
| 10 | Non-existence | ○ | Non-existence | ○ | Non-existence | ○ |
| 11 | Non-existence | ○ | Non-existence | ○ | Non-existence | ○ |
| 12 | Non-existence | ○ | Non-existence | ○ | Non-existence | ○ |
| 13 | Non-existence | ○ | Non-existence | ○ | Non-existence | ○ |
| 14 | Non-existence | Δ | Non-existence | Δ | Non-existence | Δ |
| 15 | Non-existence | ○ | Non-existence | ○ | Non-existence | ○ |
| 16 | Non-existence | ○ | Non-existence | ○ | Non-existence | ○ |
| 17 | Non-existence | ○ | Non-existence | ○ | Non-existence | ○ |
| 18 | Non-existence | ○ | Non-existence | ○ | Non-existence | ○ |
| 19 | Non-existence | ○ | Non-existence | ○ | Existence | — |
| 20 | Existence | — | Existence | — | Existence | — |
| 21 | Non-existence | ○ | Non-existence | ○ | Non-existence | ○ |
| 22 | Non-existence | ○ | Non-existence | ○ | Non-existence | ○ |
| 23 | Non-existence | ○ | Non-existence | ○ | Non-existence | ○ |
| 24 | Non-existence | Δ | Non-existence | Δ | Existence | — |
| 25 | Non-existence | Δ | Non-existence | Δ | Non-existence | Δ |
| 26 | Existence | — | Existence | — | Existence | — |
| 27 | Non-existence | ○ | Non-existence | ○ | Non-existence | ○ |
| 28 | Existence | — | Existence | — | Existence | — |

TABLE 8-continued

| No. | Wire drawing condition1 600 m/min | | Wire drawing condition2 800 m/min | | Wire drawing condition3 (number of dies is reduced) 800 m/min | |
|---|---|---|---|---|---|---|
| | Existence of disconnection | Service life of die | Existence of disconnection | Service life of die | Existence of disconnection | Service life of die |
| 29 | Non-existence | ○ | Non-existence | ○ | Non-existence | ○ |
| 30 | Non-existence | ○ | Non-existence | ○ | Non-existence | ○ |
| 31 | Existence | — | Existence | — | Existence | — |
| 32 | Non-existence | ○ | Non-existence | ○ | Existence | — |
| 33 | Non-existence | ○ | Non-existence | ○ | Non-existence | ○ |
| 34 | Non-existence | ○ | Non-existence | ○ | Non-existence | ○ |

A high carbon steel wire material having excellent wire drawability can be obtained by controlling especially the average crystal grain diameter ($D_{ave}$) of a carbon steel wire which satisfies the predetermined requirements for composition to 20 μm or less and the maximum crystal grain diameter ($D_{max}$) to 120 μm or less and reducing variations in the sizes of the metal structure units and making the metal structure uniform and fine.

The invention claimed is:

1. A process for manufacturing a high carbon steel wire material having excellent wire drawability, the process comprising heating at 730 to 1,050° C. a steel comprising 0.6 to 1.1% by mass of C,
0.1 to 2.0% by mass of Si,
0.1 to 1.0% by mass of Mn,
0.020% or less by mass of P,
0.020% or less by mass of S,
0.006% or less by mass of N,
0.03% or less by mass of Al and
0.0030% or less by mass of O,
the balance being Fe and unavoidable impurities;

then cooling the steel to a temperature $T_1$ in a range of from 470 to 640° C. at an average cooling rate of 15° C./sec or more; and then heating the steel to a temperature $T_2$ in a range of from 550 to 720° C. at an average temperature elevation rate of 3° C./sec or more, where $T_2$ is higher than $T_1$, wherein TS as the tensile strength of the steel wire material and Wc as the C concentration in the steel wire material satisfy the following relation (1):

$$TS \leqq 1240 \times Wc^{0.52} \quad (1).$$

2. The process according to claim 1, wherein the steel further comprises at least one selected from the group consisting of 1.5% or less (not including 0%) by mass of Cr,
1.0% or less (not including 0%) by mass of Cu, and
1.0% or less (not including 0%) by mass of Ni.

3. The process according to claim 1, wherein the steel further comprises at least one selected from the group consisting of 5 ppm or less (not including 0 ppm) of Mg,
5 ppm or less (not including 0 ppm) of Ca, and
1.5 ppm or less (not including 0 ppm) of REM.

4. A process for manufacturing a high carbon steel wire material having excellent wire drawability, the process comprising heating at 900 to 1,260° C. a steel comprising 0.6 to 1.1% by mass of C,
0.1 to 2.0% by mass of Si,
0.1 to 1.0% by mass of Mn,
0.020% or less by mass of P,
0.020% or less by mass of S,
0.006% or less by mass of N,
0.03% or less by mass of Al and
0.0030% or less by mass of O,
the balance being Fe and unavoidable impurities:

then hot rolling the steel at a temperature of 740° C. or higher to subject the steel to finish rolling at a temperature of 1,100° C. or lower;

then cooling the steel with water to 750 to 950° C. and winding the steel on a conveyor device;

then cooling the steel at an average cooling rate of 15° C./sec or more to a temperature $T_3$ in a range of from 500 to 630° C. within 20 seconds after the winding; and then reheating the steel to a temperature $T_4$ in a range of from 580 to 720° C. within 45 seconds after the winding, where $T_4$ higher than $T_3$, wherein TS as the tensile strength of the steel wire material and Wc as the C concentration in the steel wire material satisfy the following relation (1):

$$TS \leqq 1240 \times Wc^{0.52} \quad (1).$$

5. The process according to claim 4, wherein the steel further comprises at least one selected from the group consisting of 1.5% or less (not including 0%) by mass of Cr.
1.0% or less (not including 0%) by mass of Cu, and
1.0% or less (not including 0%) by mass of Ni.

6. The process according to claim 4, wherein the steel further comprises at least one selected from the group consisting of 5 ppm or less (not including 0 ppm) of Mg,
5 ppm or less (not including 0 ppm) of Ca, and
1.5 ppm or less (not including 0 ppm) of REM.

7. The process according to claim 1, wherein the steel wire material mainly comprises pearlite.

8. The process according to claim 1, wherein the steel wire material comprises bcc-Fe crystal grains having an average crystal grain diameter ($D_{ave}$) of 20 μm or less and a maximum crystal grain diameter ($D_{max}$) of 120 μm or less.

9. The process according to claim 1, wherein the steel wire material comprises bcc-Fe crystal grains having a diameter of 80 μm or more in an area ratio of 40% or less.

10. The process according to claim 1, further comprising, after the heating to 550 to 720° C., drawing the steel into a wire.

11. The process according to claim 4, wherein the steel wire material mainly comprises pearlite.

12. The process according to claim 4, wherein the steel wire material comprises bcc-Fe crystal grains having an average crystal grain diameter ($D_{ave}$) of 20 μm or less and a maximum crystal grain diameter ($D_{max}$) of 120 μm or less.

13. The process according to claim 4, wherein the steel wire material comprises bcc-Fe crystal grains having a diameter of 80 μm or more in an area ratio of 40% or less.

14. The process according to claim 4, further comprising, after the reheating, drawing the steel into a wire.

* * * * *

UNITED STATES PATENT AND TRADEMARK OFFICE

CERTIFICATE OF CORRECTION

PATENT NO. : 8,470,105 B2
APPLICATION NO. : 12/466865
DATED : June 25, 2013
INVENTOR(S) : Takuya Kochi et al.

It is certified that error appears in the above-identified patent and that said Letters Patent is hereby corrected as shown below:

On the title page, Item (73), the Assignee's Information is incorrect. Item (73) should read:

--(73) Assignee: Kobe Steel, Ltd., Kobe-shi (JP)--

Signed and Sealed this
Twenty-seventh Day of August, 2013

Teresa Stanek Rea
*Acting Director of the United States Patent and Trademark Office*